US012005300B2

(12) United States Patent
Carini

(10) Patent No.: US 12,005,300 B2
(45) Date of Patent: Jun. 11, 2024

(54) ROWING MACHINE ADAPTOR

(71) Applicant: David V. Carini, Schaumburg, IL (US)

(72) Inventor: David V. Carini, Schaumburg, IL (US)

( * ) Notice: Subject to any disclaimer, the term of this patent is extended or adjusted under 35 U.S.C. 154(b) by 0 days.

(21) Appl. No.: 18/098,393

(22) Filed: Jan. 18, 2023

(65) Prior Publication Data

US 2023/0264073 A1 Aug. 24, 2023

Related U.S. Application Data

(63) Continuation of application No. 16/983,114, filed on Aug. 3, 2020, now Pat. No. 11,577,120.

(60) Provisional application No. 62/881,839, filed on Aug. 1, 2019.

(51) Int. Cl.
*A63B 22/00* (2006.01)
*A63B 21/00* (2006.01)

(52) U.S. Cl.
CPC ..... *A63B 22/0076* (2013.01); *A63B 21/4035* (2015.10); *A63B 22/0089* (2013.01); *A63B 2022/0079* (2013.01)

(58) Field of Classification Search
CPC ..... A63B 21/4035; A63B 22/0089; A63B 2022/0079; A63B 22/0076–0089; A63B 21/4033–4035; A63B 21/0442; A63B 21/16; A63B 21/1609; A63B 21/1672; A63B 22/20–203; A63B 21/4029; A63B 21/078
See application file for complete search history.

(56) References Cited

U.S. PATENT DOCUMENTS

| | | | | |
|---|---|---|---|---|
| 4,974,832 | A * | 12/1990 | Dalebout | A63B 21/4029 482/142 |
| 5,279,530 | A * | 1/1994 | Hess | A63B 21/154 482/79 |
| 6,808,476 | B2 * | 10/2004 | Zagone | A63B 21/023 482/80 |
| 7,946,963 | B1 * | 5/2011 | Schreiner | A63B 23/03575 280/223 |
| 11,541,264 | B1 * | 1/2023 | Mallard | A63B 21/169 |
| 11,577,120 | B1 * | 2/2023 | Carini | A63B 22/0089 |
| 2003/0114281 | A1 * | 6/2003 | Mackert | A63B 23/0494 482/142 |
| 2009/0143201 | A1 * | 6/2009 | Uygan | A63B 21/4031 482/121 |
| 2011/0082015 | A1 * | 4/2011 | Dreissigacker | A63B 21/00069 482/72 |
| 2013/0150216 | A1 * | 6/2013 | Bell | A63B 23/03583 482/72 |
| 2019/0054343 | A1 * | 2/2019 | Chiang | A63B 21/0552 |
| 2022/0126164 | A1 * | 4/2022 | Campbell | A63B 21/4034 |
| 2022/0193486 | A1 * | 6/2022 | Lin | A63B 22/0076 |

* cited by examiner

*Primary Examiner* — Joshua Lee
*Assistant Examiner* — Catrina A Letterman
(74) *Attorney, Agent, or Firm* — Larry E. Henneman, Jr.; Henneman & Associates, PLC

(57) ABSTRACT

A novel rowing machine attachment includes a bracket for attaching to a roller assembly of a rowing machine and a receiver for attaching to a handle of a rowing machine. In a particular embodiment, the bracket fixably attaches to the roller assembly and the receiver releasably attaches to the bracket for selective use. In a more particular embodiment, the bracket and the receiver are both integral parts of a single rigid body structure.

19 Claims, 39 Drawing Sheets

ROWING MACHINE ADAPTOR

CROSS-REFERENCE TO RELATED APPLICATIONS

This application is a continuation of co-pending U.S. application Ser. No. 16/983,114, filed Aug. 3, 2020 by the same inventor, which claims the benefit of priority to U.S. Provisional Patent Application Ser. No. 62/881,839, filed Aug. 1, 2019 by the same inventor, which are incorporated herein by reference in their entirety.

BACKGROUND OF THE INVENTION

Field of the Invention

This invention relates generally to exercise equipment, and more particularly to rowing machines.

DESCRIPTION OF THE BACKGROUND ART

Rowing machines are widely used in the exercise industry. Generally, a rowing machine includes a fixed platform that secures the user's feet in place and a seat that freely slides back and forth along a rail in a linear direction. The machine further includes a handle attached to a cable or chain that is further attached to a retractable resistance module. During a rowing movement, the user simultaneously thrusts the seat away from the platform using their leg muscles and pulls the handle using their back and arm muscles.

Although rowing machines are useful for traditional rowing exercises, they are relatively limited in terms of hosting other exercises.

SUMMARY

The present invention greatly expands the use and effectiveness of known rowing machines by providing a variety of adaptors and accessories. The adaptors and accessories facilitate many new exercises not possible with prior rowing machines. Novel adaptors and accessories, rowing machines incorporating the adaptors and accessories, and combinations of the adaptors and accessories with known rowing machines are disclosed.

An example rowing machine attachment includes a bracket and a receiver. The bracket is configured to be coupled to a rowing machine seat and to remain in a fixed position with respect to the rowing machine seat when the rowing machine seat is moved with respect to a frame of the rowing machine. The receiver is configured to be coupled to the bracket and is also configured to be selectively coupled to a rowing machine cable of the rowing machine. The receiver and the bracket thereby cooperate to selectively couple the rowing machine cable to the rowing machine seat.

In one example, rowing machine attachment, the receiver is selectively detachable from the bracket. The receiver can include a first hook and a second hook. The first hook is configured to engage a first side of a handle of the rowing machine, and the second hook is configured to engage a second side of the handle of the rowing machine. The receiver can also include a third hook, and the bracket can define a slot configured to selectively receive the third hook of the receiver.

In a non-limiting example, the receiver can also define a plurality of through-holes configured to permit the passage of seat fasteners of the rowing machine therethrough. The through-holes facilitate the attachment of the bracket to the seat of the rowing machine, by passing the fasteners through the through-holes, when the fasteners connect the seat to a roller assembly of the rowing machine.

In another example rowing machine attachment, the receiver can include a cradle configured to engage a cable member of the rowing machine.

Optionally, the bracket and the receiver can integral members of a single rigid body structure, and the receiver can include a first hook and a second hook. The first hook can be configured to engage a first side of a handle of the rowing machine, and the second hook can be configured to engage a second side of the handle of the rowing machine. The receiver can optionally or additionally include a cradle configured to engage a cable member of the rowing machine. The receiver can also define a plurality of through-holes configured to permit the passage of seat fasteners of the rowing machine therethrough. The through-holes facilitate the attachment of the bracket to the seat of the rowing machine, by passing the fasteners through the through-holes, when the fasteners connect the seat to a roller assembly of the rowing machine.

Example exercise accessories are also disclosed. As one example, the rowing machine attachment can additionally include a handle coupled to the bracket. As another example, the rowing machine attachment can include a step coupled to the bracket. As yet another example, the rowing machine attachment can include a foot harness coupled to the bracket. These, and the other examples, provided in this disclosure are non-limiting. It should be understood that any particular attachment that facilitates movement of the seat of the rowing machine could be attached to the seat and/or the bracket to facilitate operation of the rowing machine.

In other examples, the bracket can be configured to selectively engage the seat of the rowing machine, either directly or indirectly. For example, the bracket can include a hook configured to directly or indirectly engage the seat of the rowing machine. As another example, the bracket can include a closed loop configured to directly or indirectly engage the seat of the rowing machine.

Example rowing machines are also disclosed. One example rowing machine includes a resistance module; a cable, a frame, a seat, and a receiver. The cable has a first end and a second end. The first end of the cable is coupled to the resistance module. The seat is coupled to move along the frame in a back-and-forth linear motion. The receiver is fixed with respect to the seat and is configured to be coupled to the second end of the cable. When the seat is moved away from the resistance module, the receiver pulls the cable out from the resistance module, thereby operating the rowing machine without requiring the user to pull the cable by grasping a handle attached directly to the end of the cable.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an attachment that couples the resistance cable of a rowing machine to the slider assembly. In the following description, numerous specific details are set forth (e.g., seat shape, cable type, rowing machine model, etc.) in order to provide a thorough understanding of the invention. Those skilled in the art will recognize, however, that the invention may be practiced apart from these specific details. In other instances, details of well-known machine manufacturing practices (e.g., welding, cutting, fastening, etc.) and components have been omitted, so as not to unnecessarily obscure the present invention.

Figure 1:
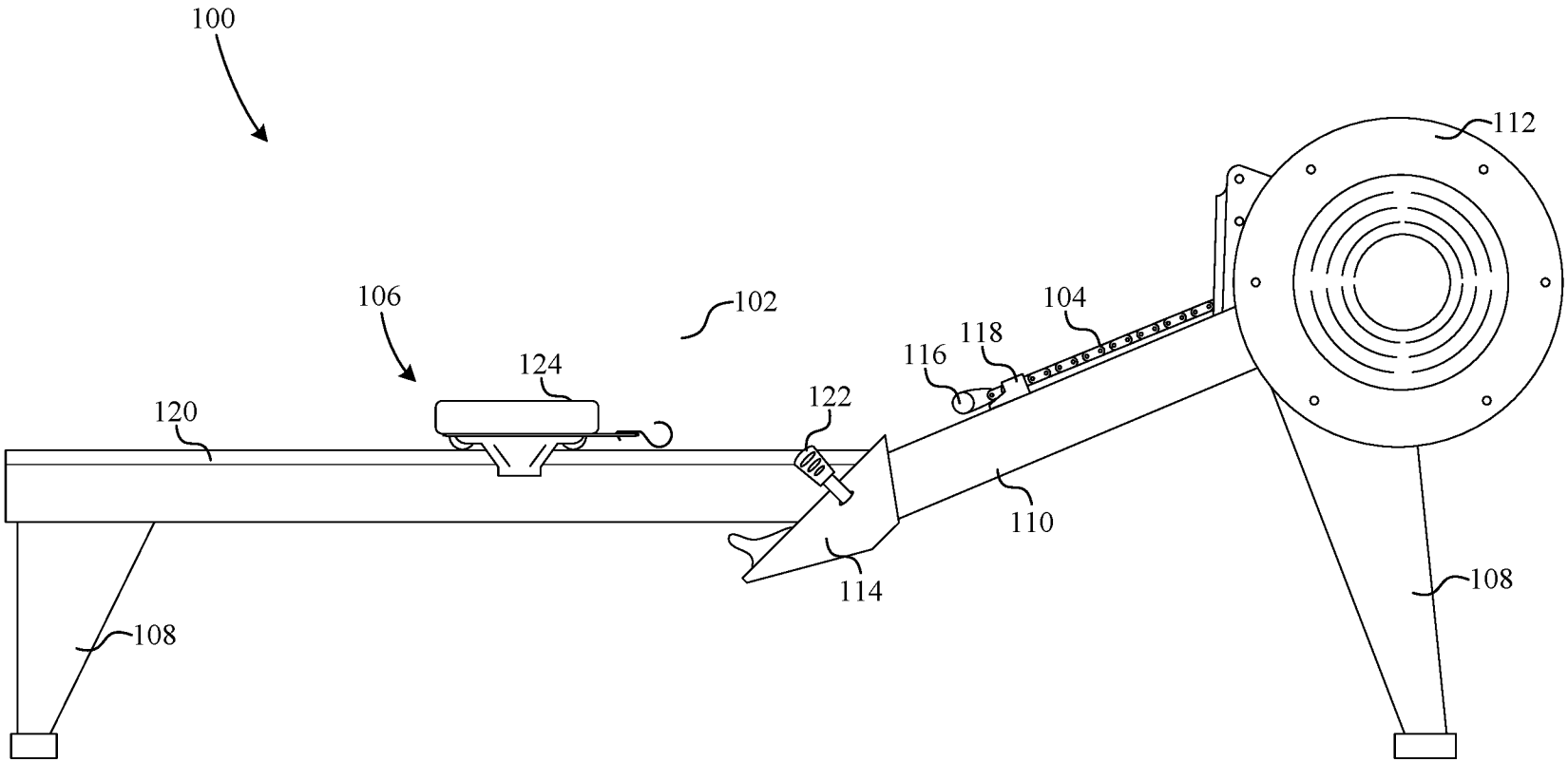
FIG. 1 is a side plan view of a rowing machine attachment mounted on a rowing machine.

FIG. 1 shows a side view of a rowing machine 100 including an attachment 102 for selectively coupling a resistance cable 104 to a roller assembly 106. In the example embodiment, cable 104 is a chain. Note that the term "cable", as used herein, broadly refers to any type flexible tensile member including, but not limited to, a chain, a steel cable, a belt, etc.

Machine 100 further includes a set of support legs 108, a frame 110, a retractable resistance module 112, a foot platform 114, a handle 116, and a handle catch 118. Support legs 108 support machine 100 on a surface such as, for example, a gym floor. Frame 110 provides structural support to module 112 and includes a guide rail 120 that facilitates the back and forth linear displacement of slider assembly 106 thereon. Resistance module 112 is operable to provide resistance to cable 104 when cable 104 is pulled therefrom and also to retract cable 104. Of course, such resistance is adjustable to accommodate for different user strengths. Foot platform 114 provides a base for the user's feet to urge against during operation of machine 100. Furthermore, foot platform 114 includes straps 122 to secure the user's feet thereto. Handle 116 is coupled to cable 104 to provide a gripping surface for the user to pull. Handle catch 118 is configured to engage handle 116 to prevent it from being completely retracted into module 112 when it is not being used. Roller assembly 106 includes attachment 102 and a seat 124. It should be understood that when handle 116 is seated in catch 118, roller assembly 106 is free to smoothly roll back and forth along guide rail 120 with little to no significant resistance.

A conventional rowing exercise will now be described. First, a user sits on seat 124 and secures his/her feet to platform 114 via straps 122. Then, the user grabs handle 116 and pulls, thereby releasing handle 116 from catch 118. Next, the user extends his/her legs, causing assembly 106 to slide away from module 112 along rail 120. At the same time, the user pulls handle 116 thereby causing cable 104 to be extracted from module 112. Finally, the user bends his/her legs to their original starting position causing assembly 106 to reverse direction and roll back along rail 120, while cable 104 is retracted back into module 112.

Figure 2:
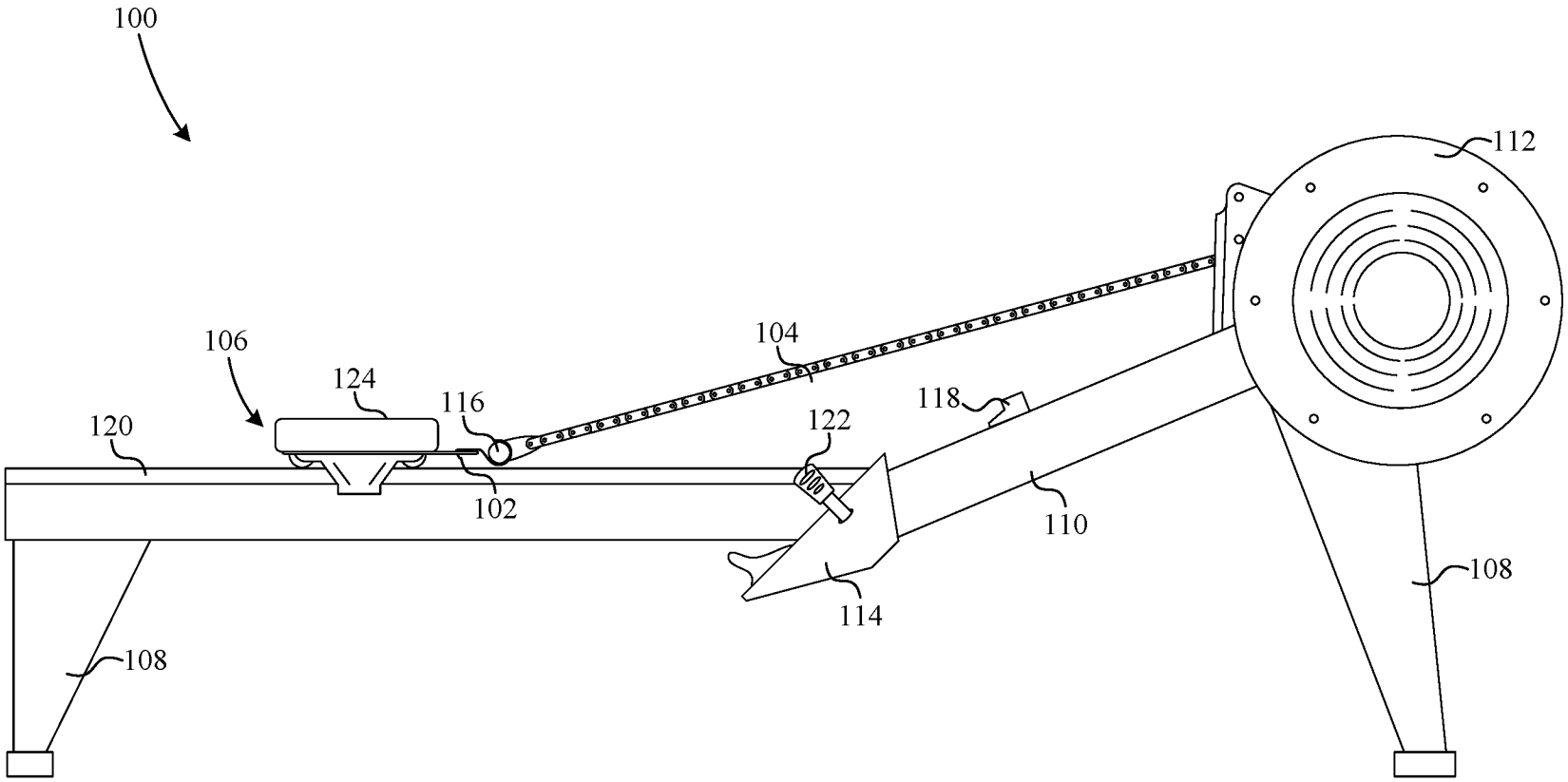
FIG. 2 is a side plan view of the rowing machine attachment of FIG. 1 shown attached to the handle of the rowing machine.

FIG. 2 shows a side view of machine 100 in an optional configuration wherein handle 116 is coupled to attachment 102. In this particular configuration, the resistance exerted on cable 104 by module 112 is directly transferred/exerted on assembly 106. In other words, cable 104 and module 112 provide resistance to moving seat 124 along rail 120, away from module 112. As a result, machine 100 can be used for many additional types of exercises that are not possible with traditional rowing machines.

Figure 3:
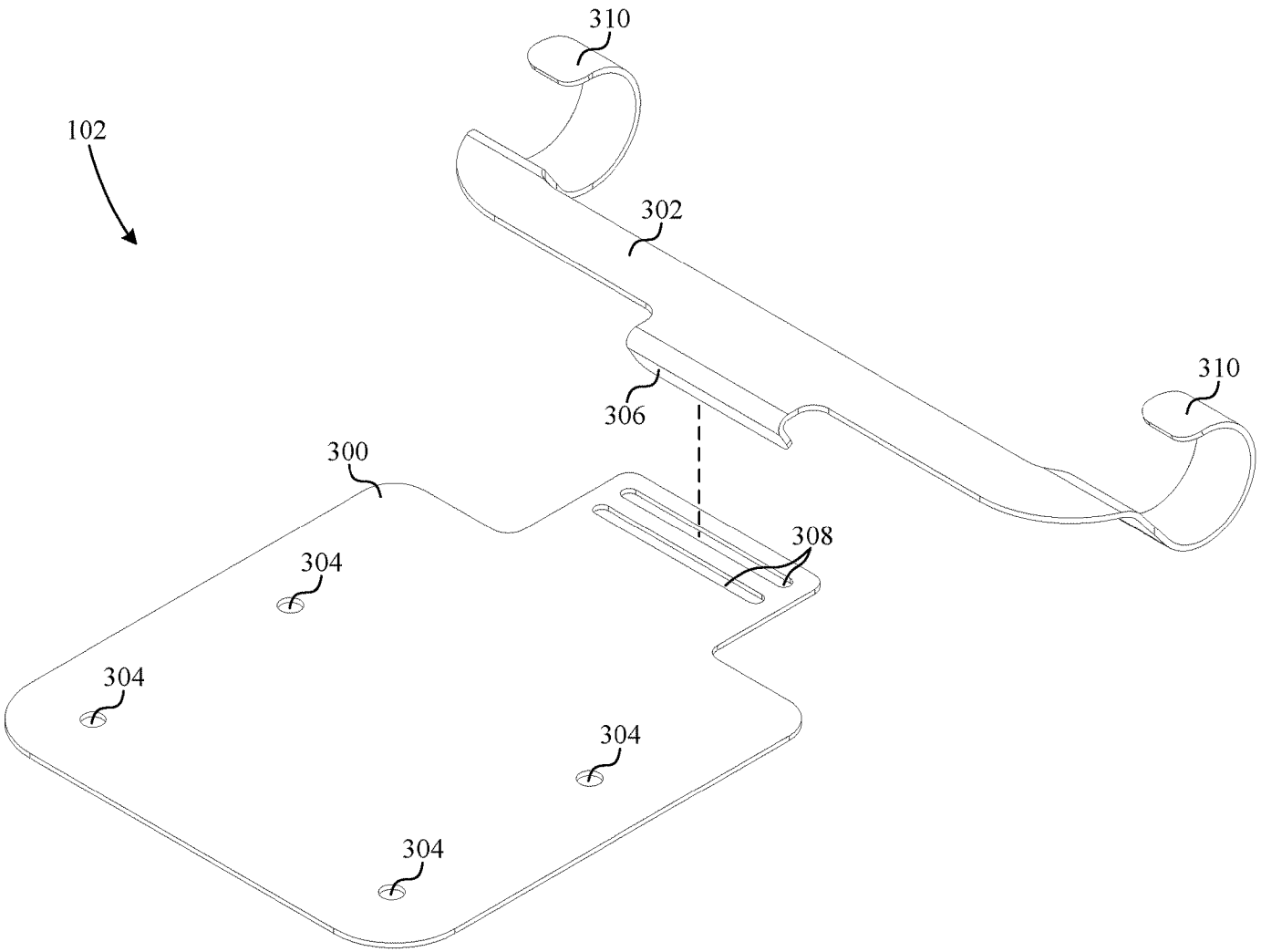
FIG. 3 is a perspective view of the rowing machine attachment of FIG. 1 in a disengaged state.

FIG. 3 shows an exploded perspective view of attachment 102, which includes a bracket 300 and a receiver 302 shown disconnected from one another.

Bracket 300 is configured to be fixably mounted to roller assembly 106. This is achieved by first removing the four screws (not shown) that secure seat 124 to the rest of roller assembly 106. Then, bracket 300 is positioned between seat 124 and the rest of roller assembly 106 such that the four through-holes 304 of bracket 300 are coaxially aligned with four respective screw-holes at the bottom of seat 124 and also coaxially aligned with the four respective screws that secure seat 124 to the rest of roller assembly 106. Finally, the four screws of roller assembly 106 are tightened into the four respective screw-holes formed at the bottom of seat 124, thereby sandwiching bracket 300 between seat 124 and the rest of roller assembly 106. Accordingly, bracket 300 remains fixed with respect to roller assembly 106 as roller assembly moves along rail 120.

Receiver 302 is configured to be attached to, and detached from, bracket 300. More specifically, receiver 302 includes a first hook 306 that is configured to be inserted into one of two optional slots 308 formed in bracket 300. To remove receiver 302 from bracket 300, the user simply lifts receiver 302 to disengage hook 306 from slots 308. This allows the user to operate rowing machine 100 the traditional way without having to remove bracket 300 from roller assembly 106. Of course, the user can reattach receiver 302 by simply inserting hook 306 back into one of slots 308.

Receiver 302 is also configured to receive handle 116 of rowing machine 100 so as to impart the resistive force from module 112 directly to roller assembly 106 through cable 104. Indeed, when handle 116 is engaged by a set of hooks 310 of receiver 302, roller assembly 106 resists moving away from module 112 along rail 120. In this example, left and right hooks 310 are each configured to engage a respective left and right grip of handle 116.

Figure 4:
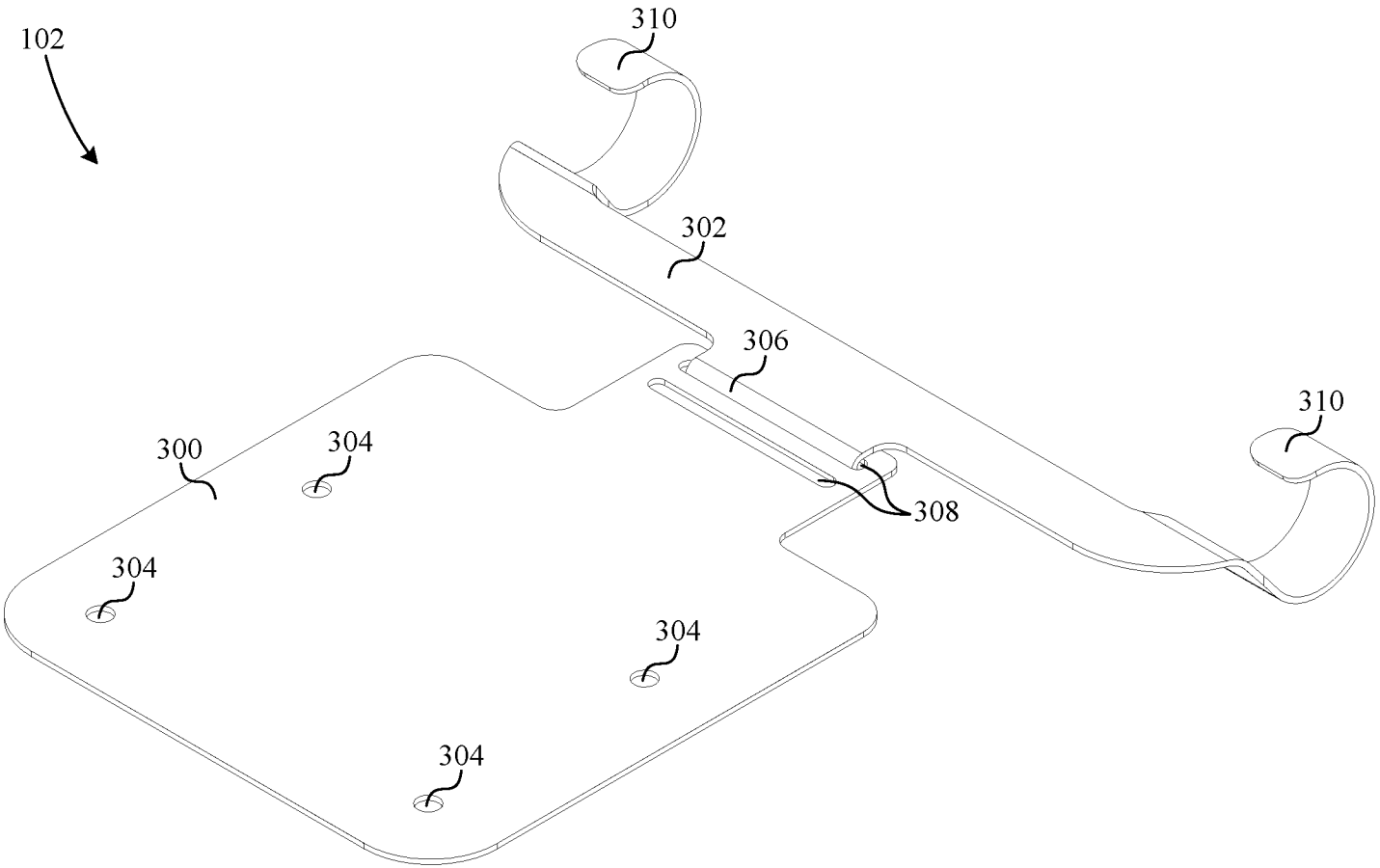
FIG. 4 is a perspective view of the rowing machine attachment of FIG. 1 in an engaged state.

FIG. 4 shows a perspective view of attachment 102 wherein receiver 302 is shown attached to bracket 300. Hook 306 is shown inserted into the front one of slots 308 but could optionally be disposed in the rear one of slots 308.

Figure 5:
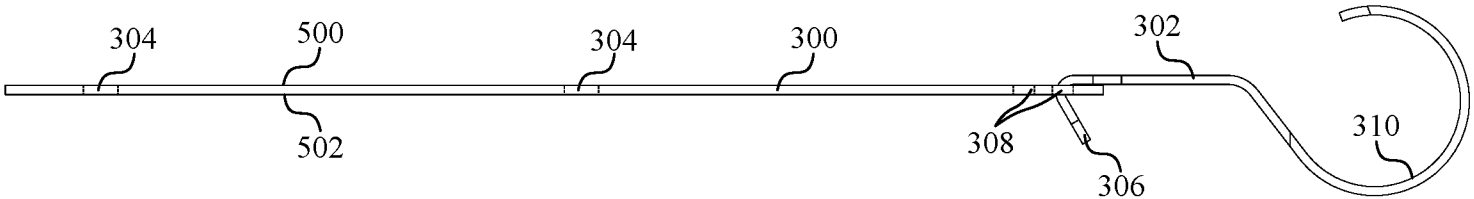
FIG. 5 is a side plan view of the rowing machine attachment of FIG. 1 in the engaged state.

FIG. 5 shows a side plan view of attachment 102 wherein hook 306 of receiver 302 is shown disposed in one of slots 308. As shown, through-holes 304 pass completely from a top surface 500 of bracket 300 to an opposite bottom surface 502 of bracket 300.

Figure 6:
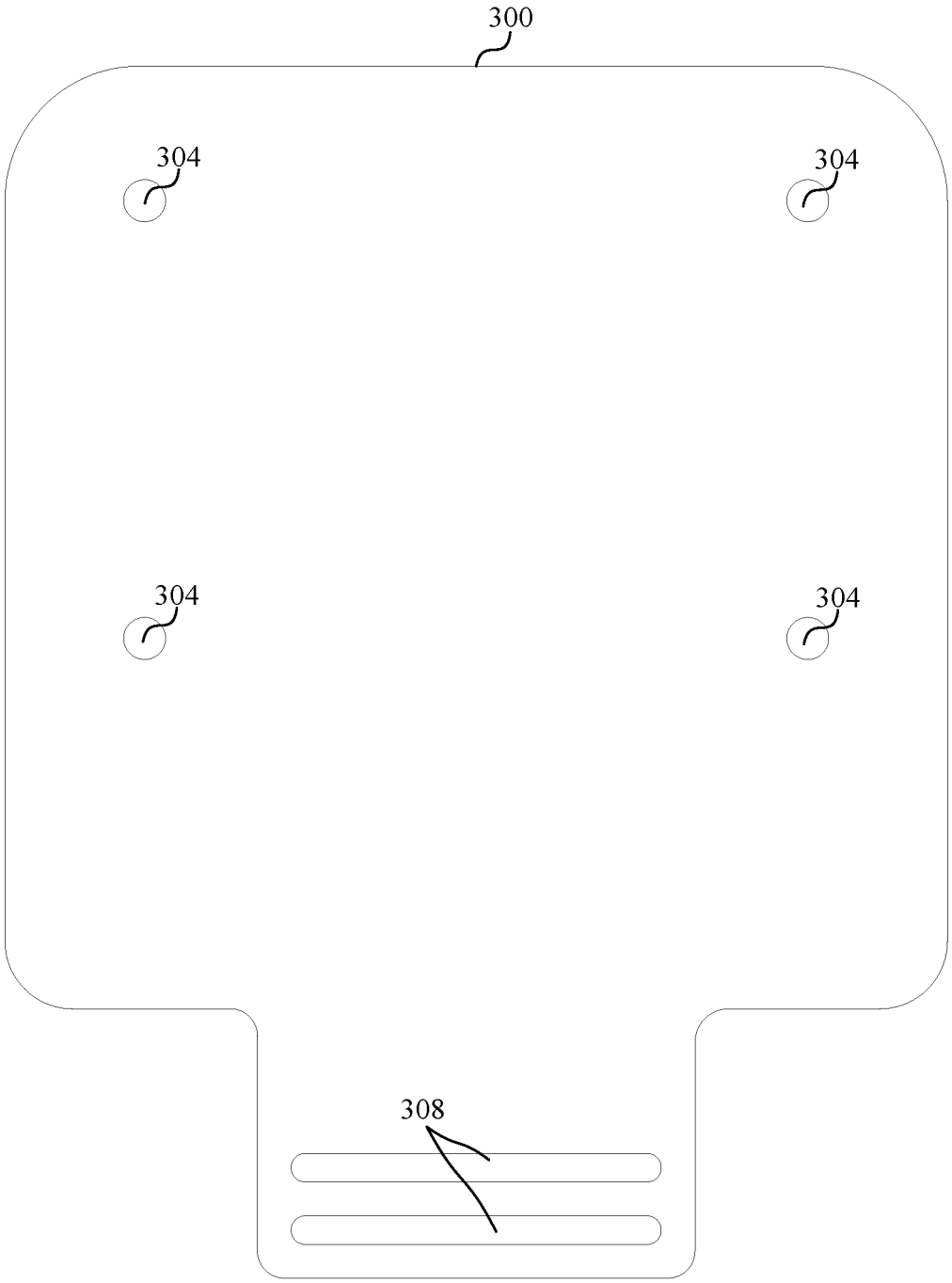
FIG. 6 is a top plan view of the bracket of the rowing machine attachment of FIG. 1.

FIG. 6 shows top plan view of bracket 300. Although bracket 300 is shown to include four through-holes 304 disposed in a square configuration, bracket 300 could include any number of through-holes 304 in any configuration depending on the particular seat screw configuration of the host rowing machine without departing from the main scope of the invention. Likewise, bracket 300 may include any number of slots 308. In the example embodiment, bracket 300 is a plate formed from sheet metal.

Figure 7:
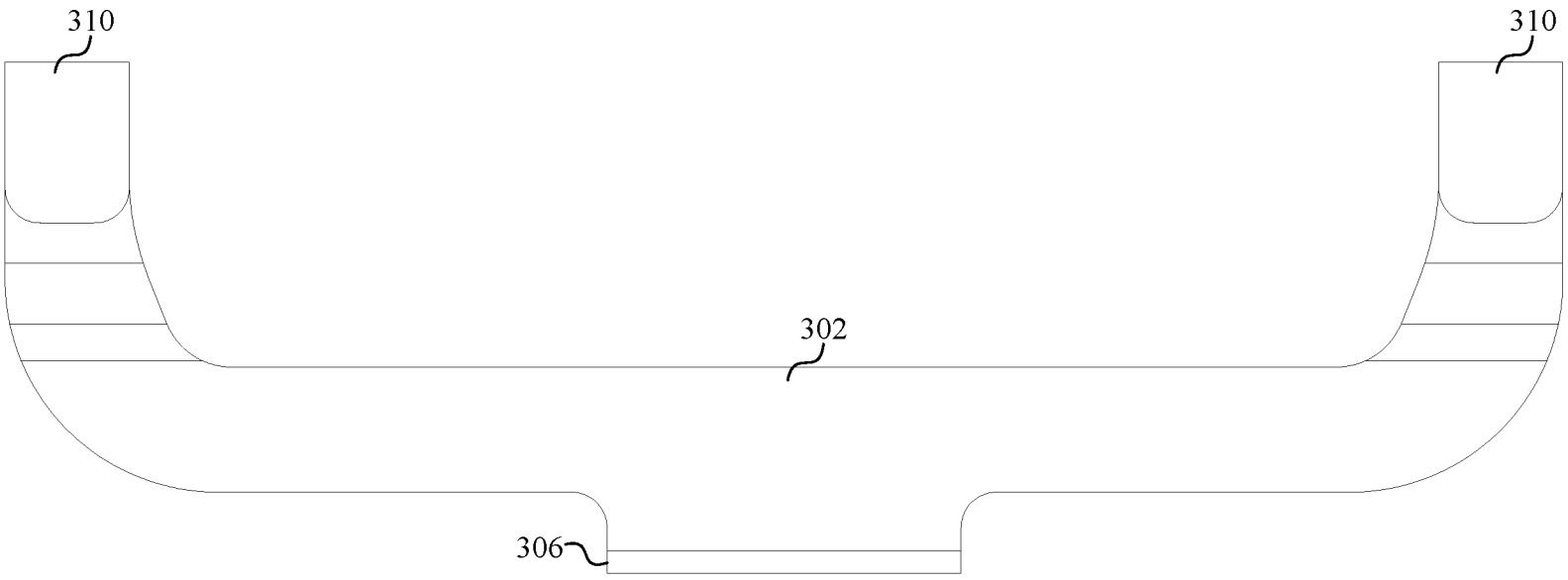
FIG. 7 is a top plan view of the receiver of the rowing machine attachment of FIG. 1.

FIG. 7 shows a top plan view of receiver 302 disconnected from bracket 300. As shown, hooks 310 are symmetrically spaced on opposite sides of the center of hook 306 to maintain even engagement with handle 116.

Figure 8:
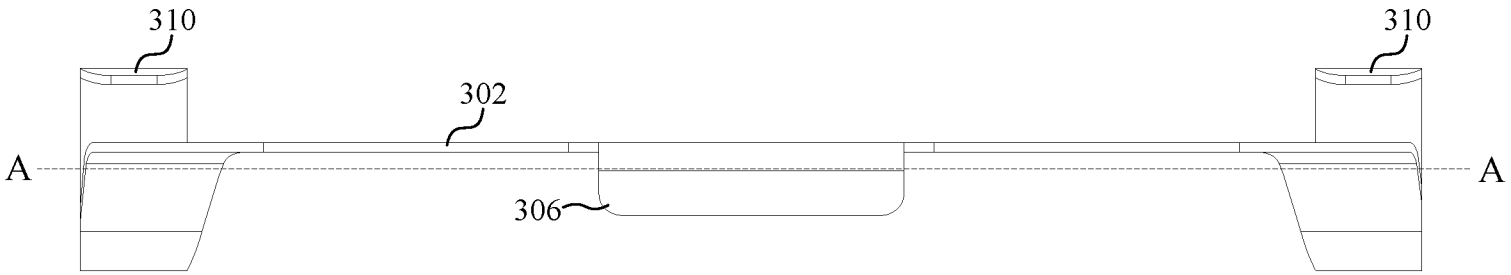
FIG. 8 is a rear plan view of the receiver of the rowing machine attachment of FIG. 1.

FIG. 8 shows a front plan view of receiver 302 disconnected from bracket 300. As shown, the center of hooks 310, where most tensile support is applied during operation, is substantially aligned with the center of hook 306 as indicated by the hashed line A-A.

Figure 9:
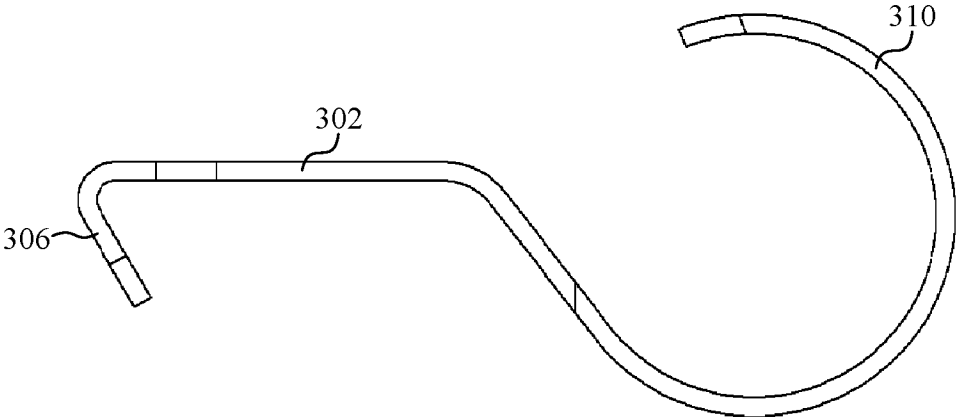
FIG. 9 is a side plan view of the receiver of the rowing machine attachment of FIG. 1.

FIG. 9 shows a side plan view of receiver 302 disconnected from bracket 300.

Figure 10:
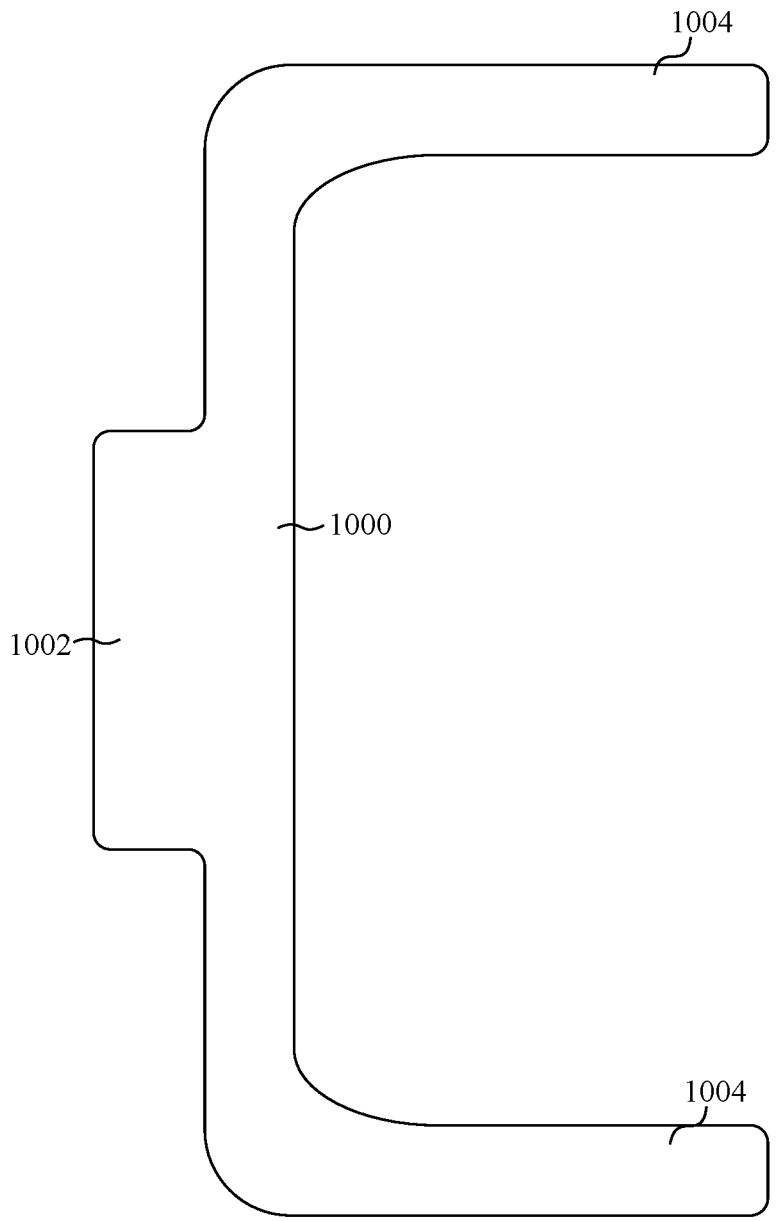
FIG. 10 is a plan view of a blank used to form the receiver of the rowing machine attachment of FIG. 1.

FIG. 10 shows a top plan view of a sheet metal blank 1000 from which receiver 302 is formed. Blank 1000 includes a middle portion 1002 and two outside portions 1004 from which hook 306 and hooks 310, respectively, are formed. After blank 1000 is stamped or cut from a section of sheet metal, portion 1002 is bent to form hook 306 and portions 1004 are bent to form hooks 310.

Figure 11:
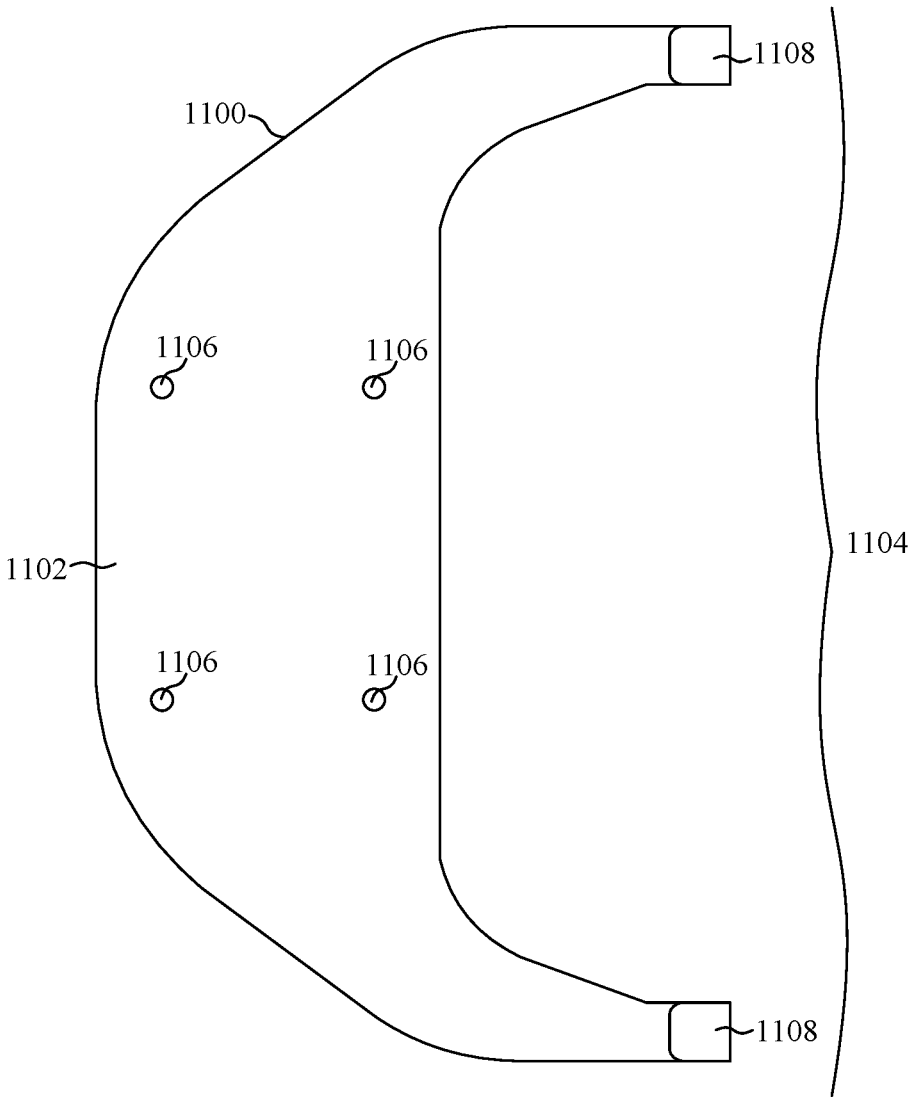
FIG. 11 is a top plan view of an alternate rowing machine attachment.

FIG. 11 shows a top plan view of a rowing machine attachment 1100 according to an alternate embodiment. Attachment 1100 includes a bracket 1102 and a receiver 1104 integrally formed as a single monolithic structure. Bracket 1102 defines a plurality of through-holes 1106 and receiver 1104 includes a set of hooks 1108, which perform the same functions as previously described through-holes 304 and hooks 310, respectively, of receiver 302.

Bracket 1102 is configured to be fixably mounted to roller assembly 106 in the same fashion as bracket 300. This is achieved by first removing the four screws (not shown) that secure seat 124 to the rest of roller assembly 106. Then, bracket 1102 is positioning between seat 124 and the rest of roller assembly 106 with hooks 1108 being disposed in the front of seat 124, between seat 124 and module 112. Furthermore, the four through-holes 1106 of bracket 1102 are coaxially aligned with four respective screw-holes at the bottom of seat 124 and also coaxially aligned with the four respective screws that secure seat 124 to the rest of roller assembly 106. Finally, the four screws of roller assembly 106 are tightened into the four respective screw-holes formed at the bottom of seat 124, thereby sandwiching bracket 1102 between seat 124 and the rest of roller assembly 106. Accordingly, bracket 1102 remains fixed with respect to roller assembly 106 as roller assembly moves along rail 120.

Receiver 1104 is also configured to receive handle 116 of rowing machine 100 so as to impart the resistive force from module 112 directly to roller assembly 106 through cable 104. Indeed, when handle 116 is engaged by hooks 1108 of receiver 1104, roller assembly 106 resists moving away from module 112 along rail 120. In this example, left and right hooks 1108 are each configured to engage a respective left and right grip of handle 116.

Figure 12:
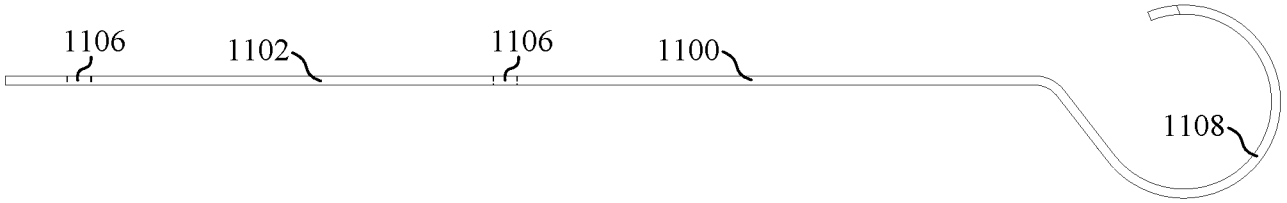
FIG. 12 is a side plan view of the rowing machine attachment of FIG. 11.

FIG. 12 shows a side plan view of a rowing machine attachment 1100. As shown, attachment 1100 has a uniform thickness throughout.

Figure 13:
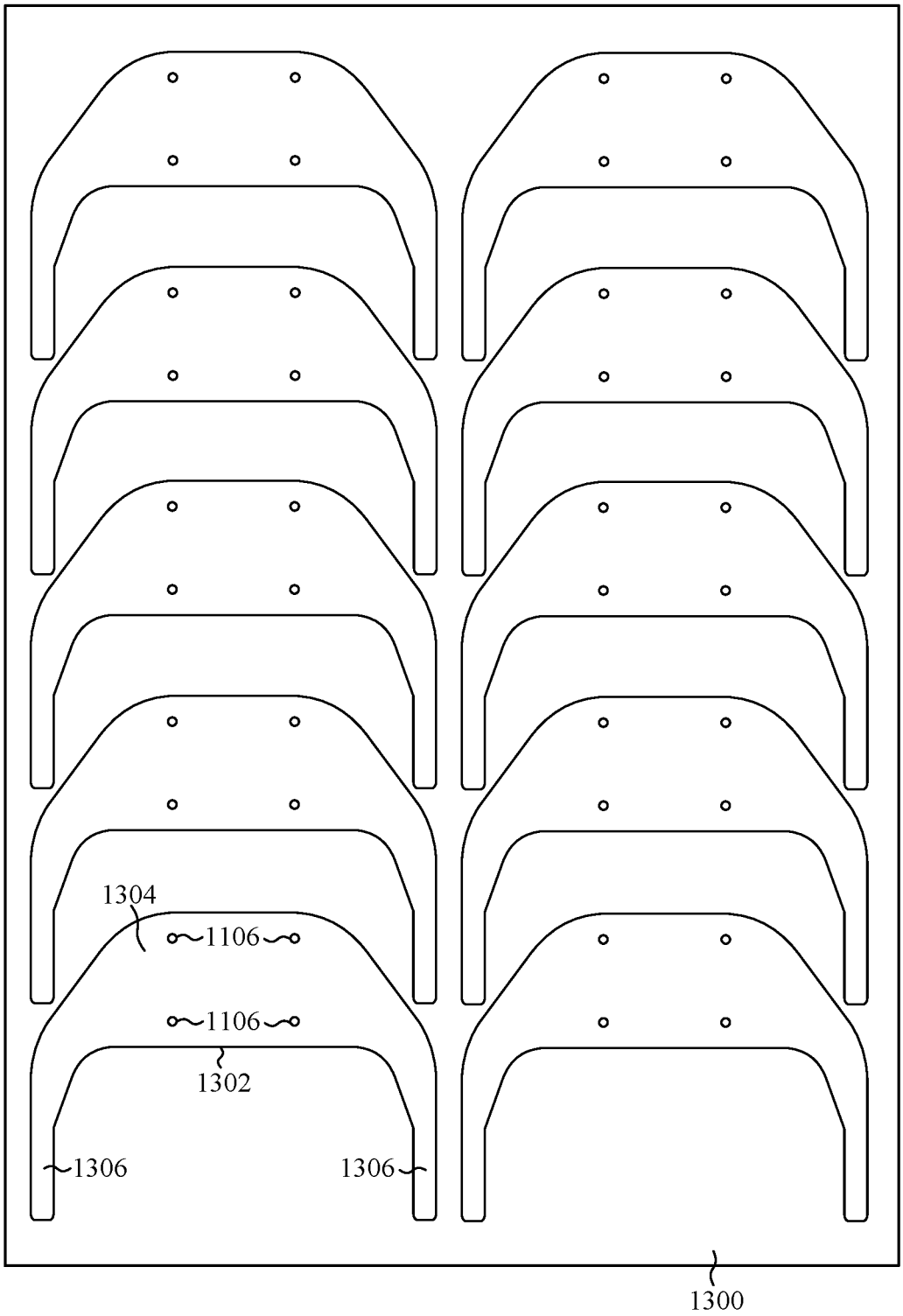
FIG. 13 is a top plan view of a section of sheet metal including a plurality of blanks used to form the rowing machine attachments of FIG. 11.

FIG. 13 shows a top plan view of a section of sheet metal 1300, from which a plurality of blanks 1302 are cut (e.g., stamped, water-jet cut, flame cut, etc.) to form a respective plurality of attachments 1100. Blanks 1302 are configured to maximize the number of attachments 1100 that are formed on sheet metal 1300. Each of blanks 1302 includes a middle portion 1304 and two outside portions 1306 from which bracket 1102 and hooks 1108, respectively, are formed. After each blank 1302 is stamped or cut from sheet metal 1300, portions 1306 are radially bent to form hooks 1108.

Figure 14:
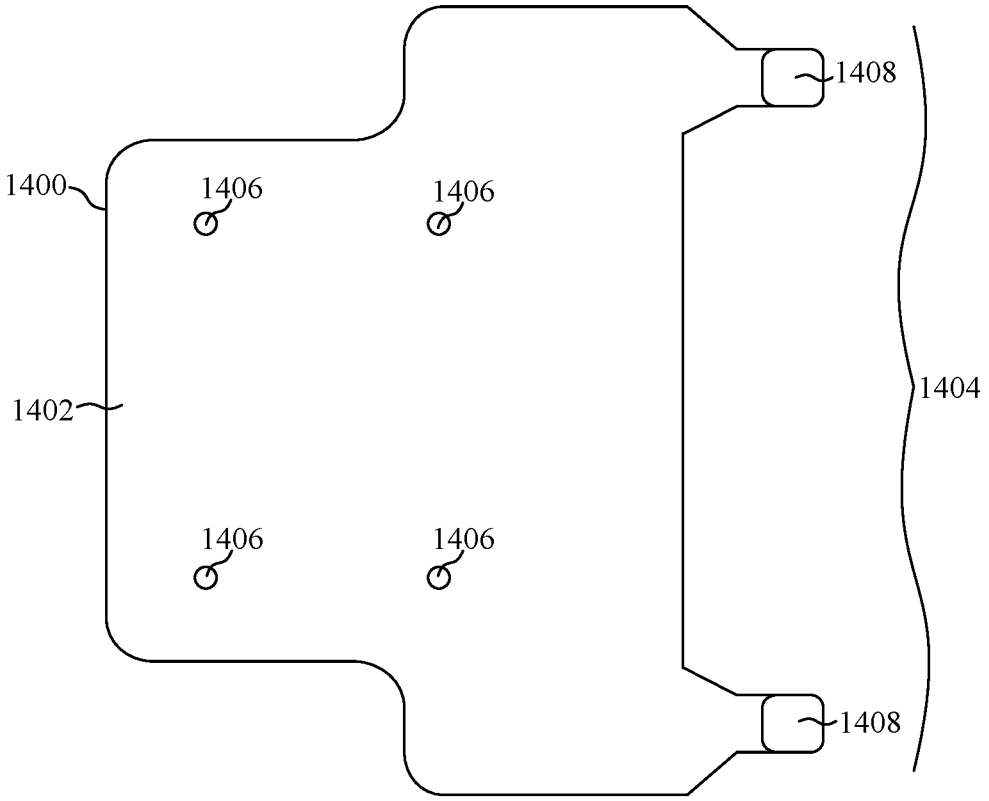
FIG. 14 is a top plan view of an alternate rowing machine attachment.

FIG. 14 shows a top plan view of a rowing machine attachment 1400 according to another alternate embodiment. Attachment 1400 includes a bracket 1402 and a receiver 1404 integrally formed as a single monolithic structure. Bracket 1402 defines a plurality of through-holes 1406 and receiver 1404 includes a set of hooks 1408, which perform the same functions as previously described through-holes 304 and hooks 310, respectively, of receiver 302.

Bracket 1402 is configured to be fixably mounted to roller assembly 106 in the same fashion as bracket 300 of attachment 102. This is achieved by first removing the four screws (not shown) that secure seat 124 to the rest of roller assembly 106. Then, bracket 1402 is positioning between seat 124 and the rest of roller assembly 106 with hooks 1408 being disposed in the front of seat 124, between seat 124 and module 112. Furthermore, the four through-holes 1406 of bracket 1102 are coaxially aligned with four respective screw-holes at the bottom of seat 124 and also coaxially aligned with the four respective screws that secure seat 124 to the rest of roller assembly 106. Finally, the four screws of roller assembly 106 are tightened into the four respective screw-holes formed at the bottom of seat 124, thereby sandwiching bracket 1402 between seat 124 and the rest of roller assembly 106. Accordingly, bracket 1402 remains fixed with respect to roller assembly 106 as roller assembly moves along rail 120.

Receiver 1404 is also configured to receive handle 116 of rowing machine 100 so as to impart the resistive force from module 112 directly to roller assembly 106 through cable 104. Indeed, when handle 116 is engaged by hooks 1108 of receiver 1404, roller assembly 106 resists moving away from module 112 along rail 120. In this example, left and right hooks 1408 are each configured to engage a respective left and right grip of handle 116.

Figure 15:
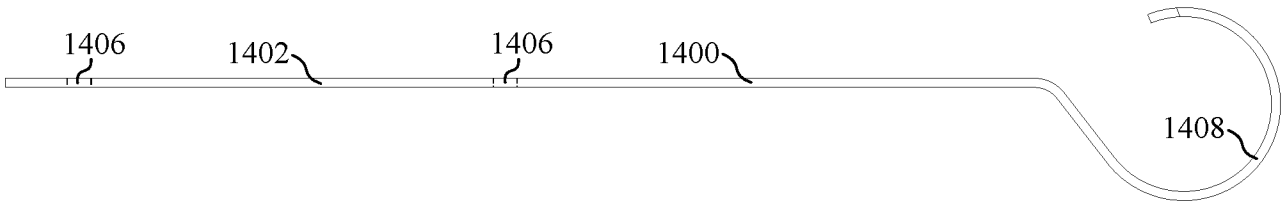
FIG. 15 is a side plan view of the rowing machine attachment of FIG. 14.

FIG. 15 shows a side plan view of a rowing machine attachment 1400. As shown, attachment 1400 has a uniform thickness throughout.

Figure 16:
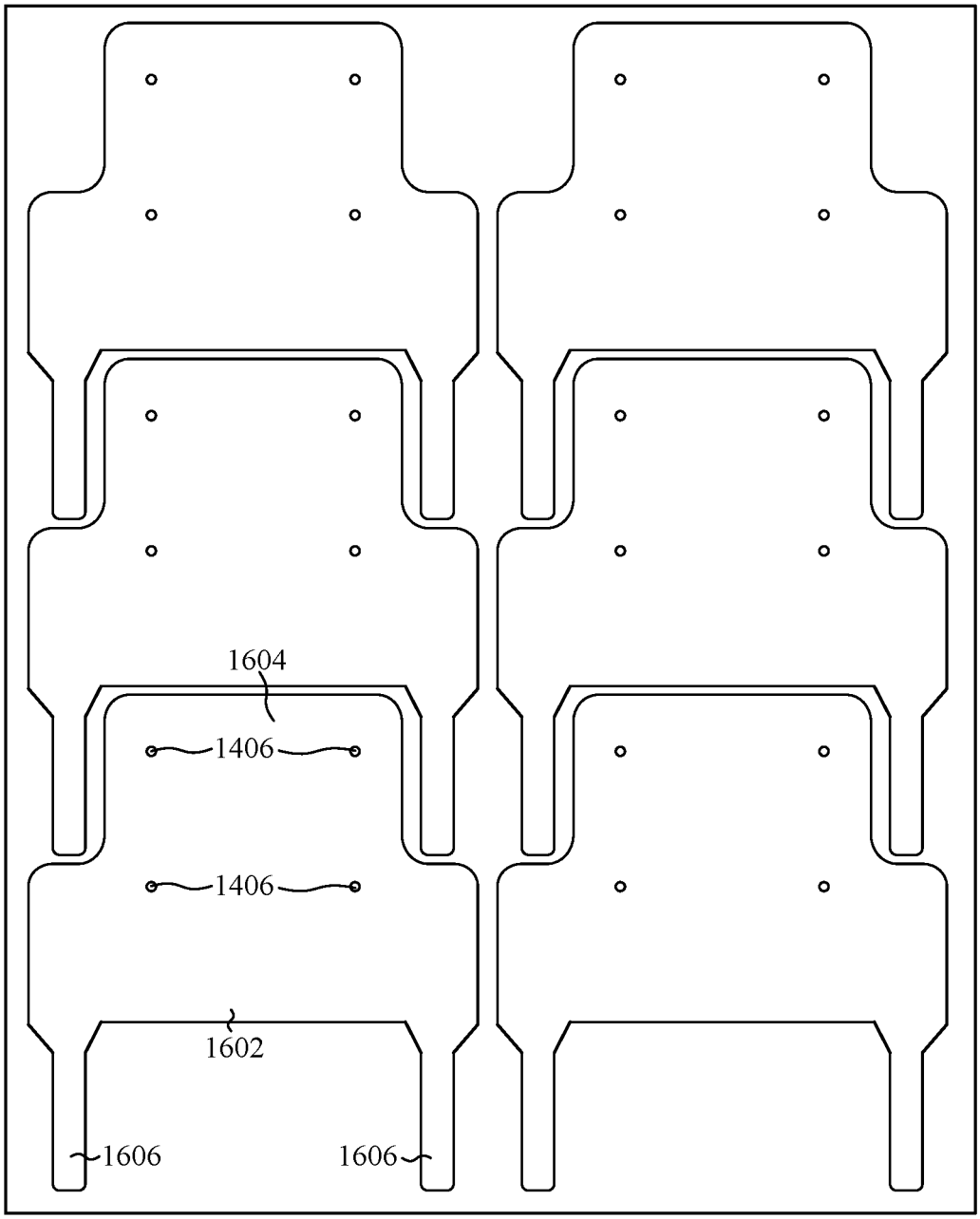
FIG. 16 is a top plan view of a section of sheet metal including a plurality of blanks used to form the rowing machine attachments of FIG. 14.

FIG. 16 shows a top plan view of a section of sheet metal 1600, from which a plurality of blanks 1602 are cut (e.g., stamped, water-jet cut, flame cut, etc.) to form a respective plurality of attachments 1400. Blanks 1602 are configured to maximize the number of attachments 1400 that are formed from sheet metal 1400. Each of blanks 1602 includes a middle portion 1604 and two outside portions 1606 from which bracket 1402 and hooks 1408, respectively, are formed. After each blank 1602 is stamped or cut from sheet metal 1600, portions 1606 are radially bent to form hooks 1408.

Figure 17:
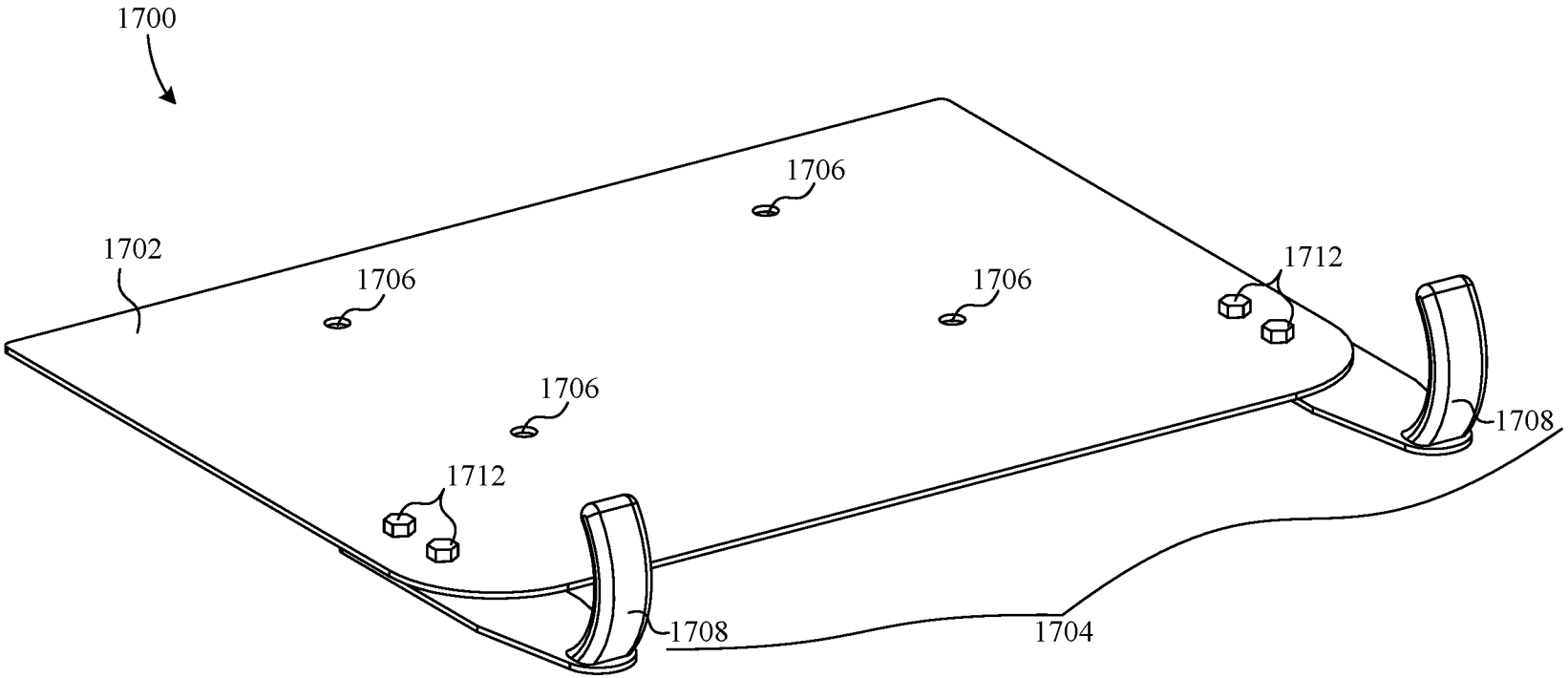
FIG. 17 is a top perspective view of an alternate rowing machine attachment.

FIG. 17 shows a top perspective view of a rowing machine attachment 1700 according to yet another alternate embodiment. Attachment 1700 includes a bracket 1702 and a receiver 1704 fastened thereto. Bracket 1702 defines a plurality of through-holes 1706 that perform the same functionality as previously described through-holes 304. Accordingly, bracket 1702 is configured to be fixably mounted to roller assembly 106 between seat 124 and the rest of roller assembly 106. Receiver 1704 includes a set of hooks 1708 attached to bracket 1702 with a set of nuts 1710 (visible in FIG. 18) and respective set of bolts 1712. Hooks 1708 provide the same functionality as hooks 310 of receiver 302. Accordingly, receiver 1704 is also configured to receive handle 116 of rowing machine 100 so as to impart the resistive force from module 112 directly to roller assembly 106 through cable 104. When handle 116 is engaged by hooks 1708 of receiver 1704, roller assembly 106 resists moving away from module 112 along rail 120. In this example, left and right hooks 1708 are each configured to engage a respective left and right grip of handle 116.

Figure 18:
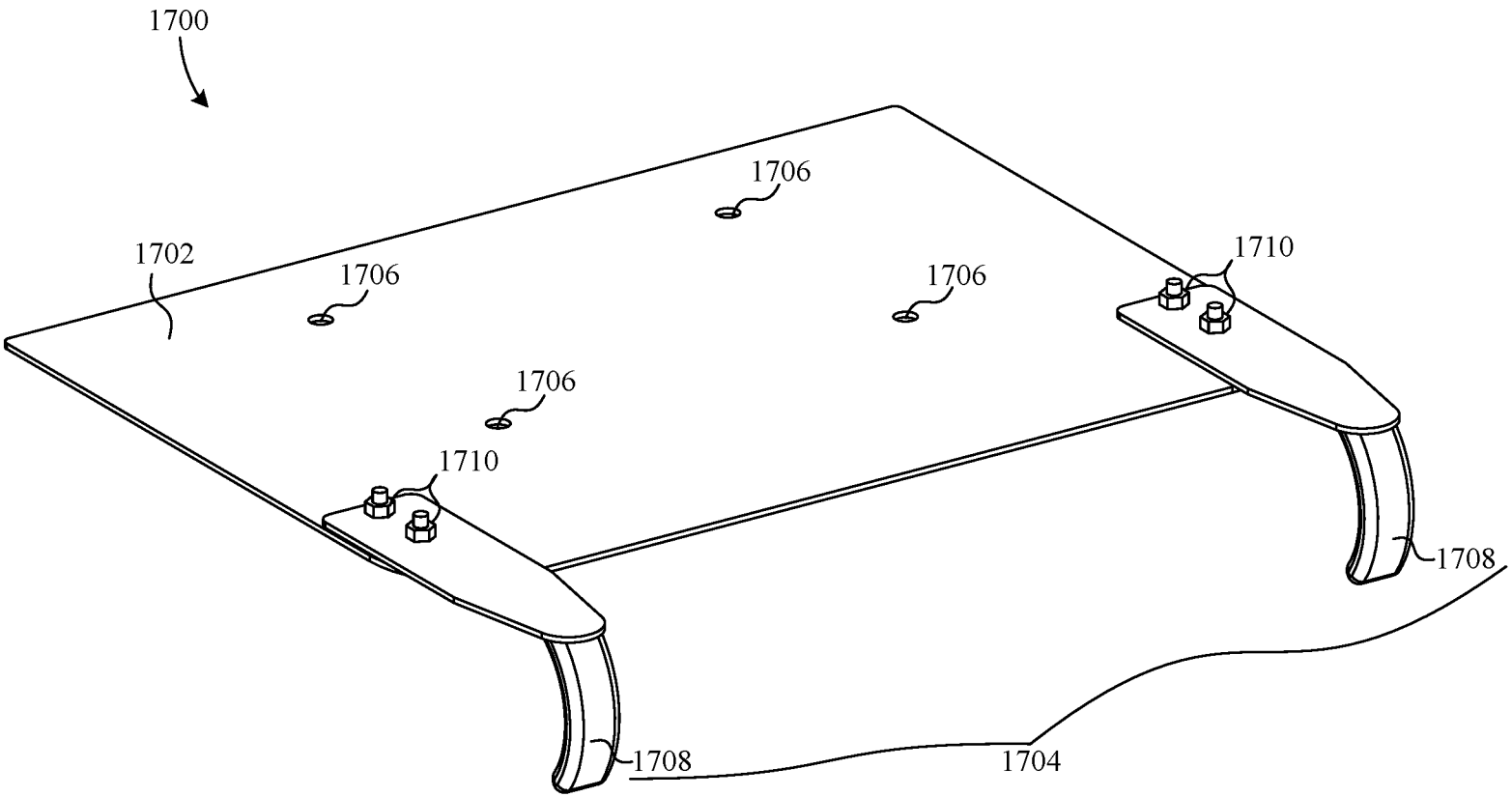
FIG. 18 is a bottom perspective view of the rowing machine attachment of FIG. 17.

FIG. 18 shows a bottom perspective view of rowing machine attachment 1700.

Figure 19:
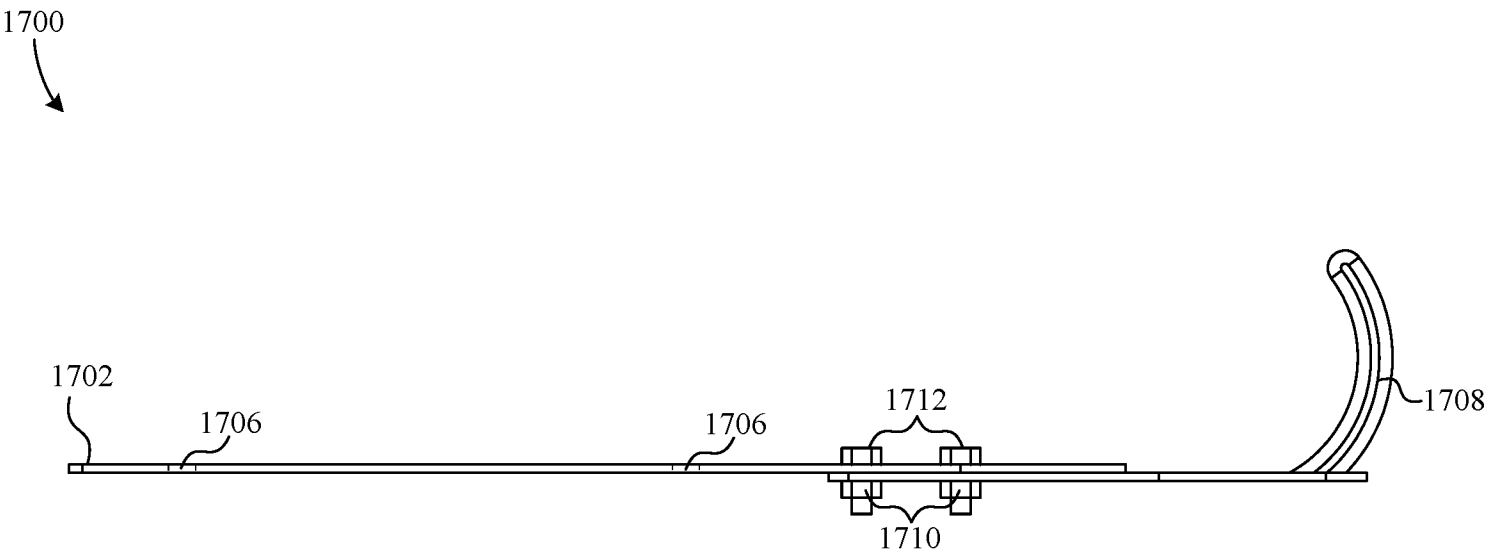
FIG. 19 is a side plan view of the rowing machine attachment of FIG. 17.

FIG. 19 shows a side plan view of rowing machine attachment 1700.

Figure 20:
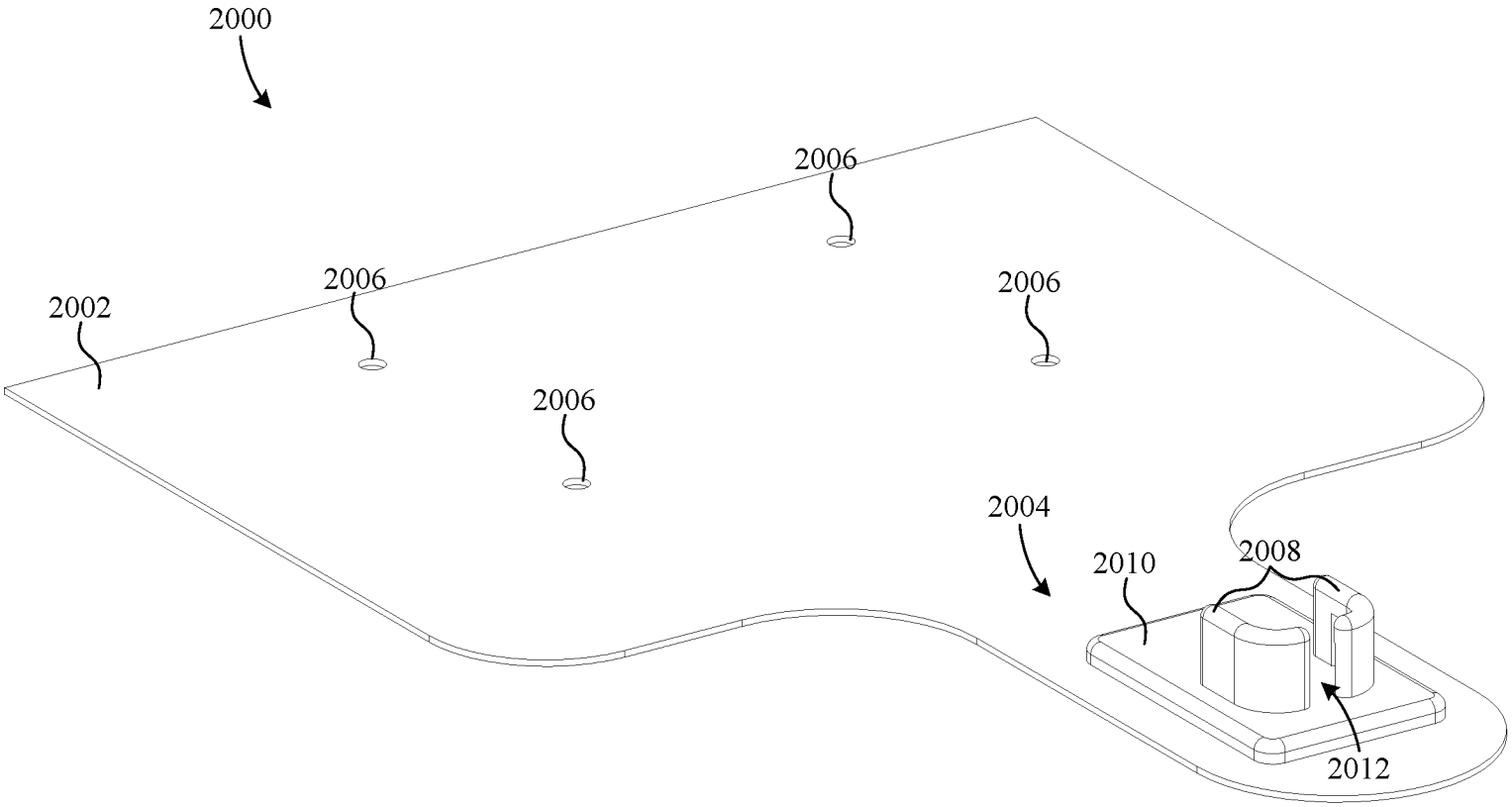
FIG. 20 is a perspective view of an alternate rowing machine attachment.

FIG. 20 shows a top perspective view of a rowing machine attachment 2000 according to yet another alternate embodiment. Attachment 2000 is configured to be mounted to roller assembly 106 so that cable 104 can be removably coupled thereto. When cable 104 is coupled to roller assembly 106, the resistance from module 112 is imparted on seat 124 when roller assembly 106 is moved away from module 112 along rail 120. Attachment 2000 includes a bracket 2002 that is attached directly to a receiver 2004.

Bracket 2002 facilitates the mounting of attachment 2000 to roller assembly 106. Bracket 2002 is a metal plate defining a plurality of through-holes 2006 that perform the same functionality as previously described through-holes 304. Accordingly, bracket 2002 is configured to be fixably mounted to roller assembly 106, between seat 124 and the rest of roller assembly 106. This is achieved by first removing the four screws (not shown) that secure seat 124 to the rest of roller assembly 106. Then, bracket 2002 is positioning between seat 124 and the rest of roller assembly 106 with receiver 2004 being disposed in the front of seat 124, between seat 124 and module 112. Furthermore, the four through-holes 2006 of bracket 2002 are coaxially aligned with four respective screw-holes at the bottom of seat 124 and also coaxially aligned with the four respective screws that secure seat 124 to the rest of roller assembly 106. Finally, the four screws of roller assembly 106 are tightened into the four respective screw-holes formed at the bottom of seat 124, thereby sandwiching bracket 2002 between seat 124 and the rest of roller assembly 106. Accordingly, bracket 2002 remains fixed with respect to roller assembly 106 as roller assembly 106 moves along rail 120.

Receiver 2004 is a cradle configured to removably seat a cable accessory (e.g., cable end bolt, cable knuckle, cable connection point of handle 116, etc.) of cable 104 so as to impart the resistive force from module 112 directly to bracket 2002 and, therefore, to roller assembly 106 through cable 104. Indeed, when a portion of cable 104 is seated in receiver 2004, roller assembly 106 resists moving away from module 112 along rail 120. In this example, receiver 2004 includes U-shaped sidewalls 2008 extending upward from a base 2010. Sidewalls 2008 define a channel 2012 that permits the passage of cable 104 therethrough but prevents any cable end accessories from passing therethrough.

Figure 21:
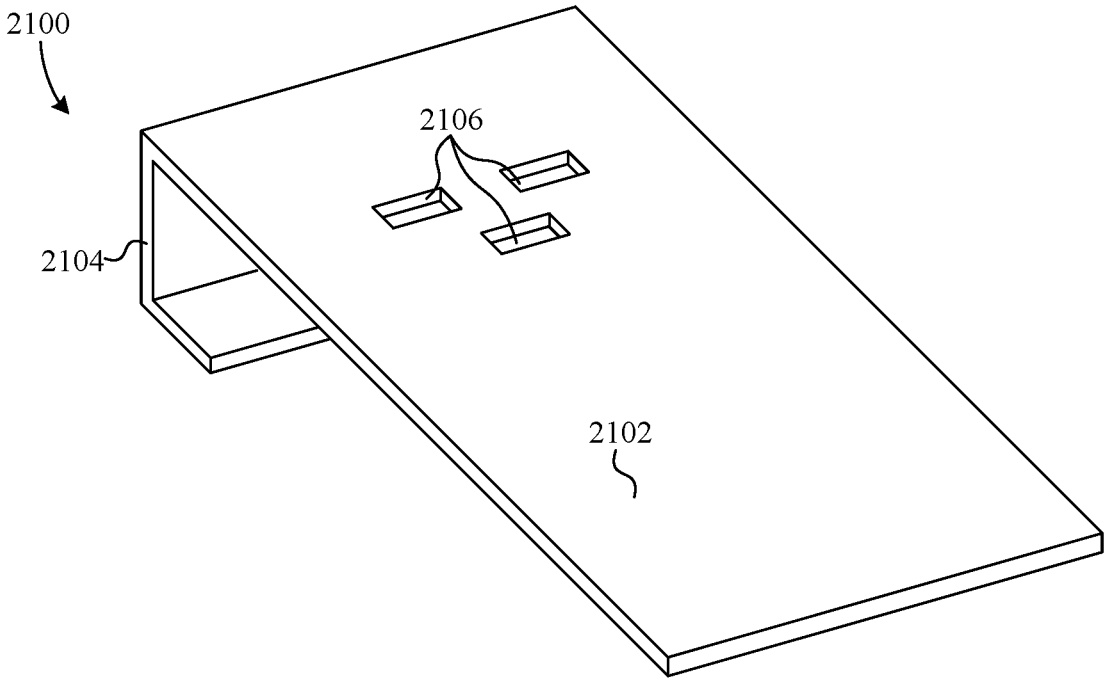
FIG. 21 is a perspective view of an alternate rowing machine accessory.

FIG. 21 shows a perspective view of a rowing machine accessory 2100 that may be used in conjunction with any of the aforementioned rowing machine attachments. Accessory 2100 is configured to engage seat 124 and is a platform that is adapted to receive various optional interchangeable attachments. As shown, accessory 2100 includes a top portion 2102 configured to rest upon seat 124 and a hook portion 2104 configured to engage the front portion of seat 124. Top portion 2102 includes a plurality of slots 2106 formed therethrough to facilitate the attachment of interchangeable attachments to accessory 2100.

Figure 22:
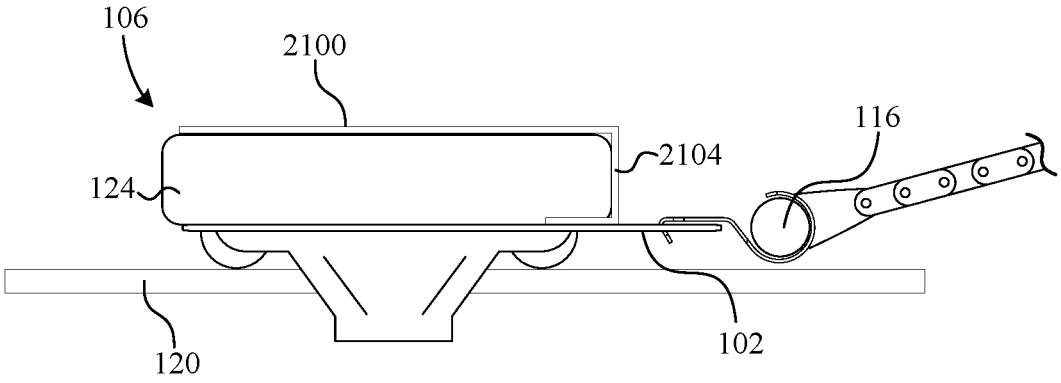
FIG. 22 is a side plan view of the rowing machine accessory of FIG. 21 attached to a rowing machine seat.

FIG. 22 shows a side plan view of accessory 2100 coupled to seat 124 of roller assembly 106. Urging accessory 2100 away from module 112 along rail 120 causes roller assembly 106 to also move away from module 112 along rail 120. Accessory 2100 can be removed from roller assembly 106 simply by lifting accessory 2100 off of seat 124.

Figure 23:
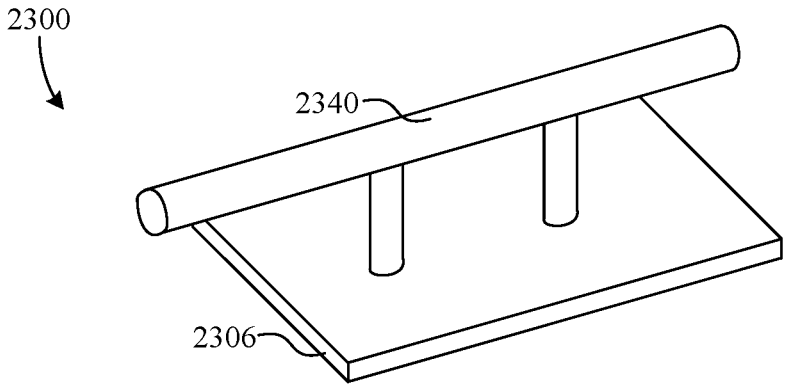
FIG. 23 is a perspective view of an attachment configured to be attached to the accessory of FIG. 21.

FIG. 23 shows a perspective view of an attachment 2300 configured to be removably attached to accessory 2100. Attachment 2300 includes a handle 2304 attached to a base 2306. Handle 2304 provides a structure for a user to grip onto with their hands during various exercises. Base 2306 facilitates the releasable mounting of attachment 2300 to accessory 2100.

Figure 24:
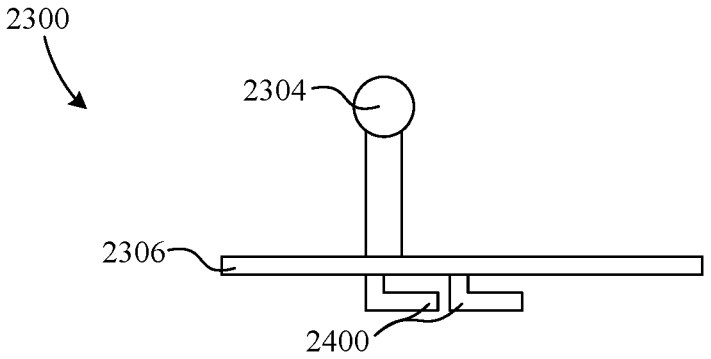
FIG. 24 is a side plan view of the attachment of FIG. 23.

FIG. 24 shows a side plan view of attachment 2300. As shown, base 2306 includes a plurality of protrusions 2400 configured to mate with slots 2106 of accessory 2100 to facilitate the removable coupling of attachment 2300 to accessory 2100. Attachment 2300 mounts to accessory 2200 by disposing each of protrusions 2400 into a respective one of slots 2106 and then sliding attachment 2300 horizontally with respect to accessory 2100.

Figure 25:
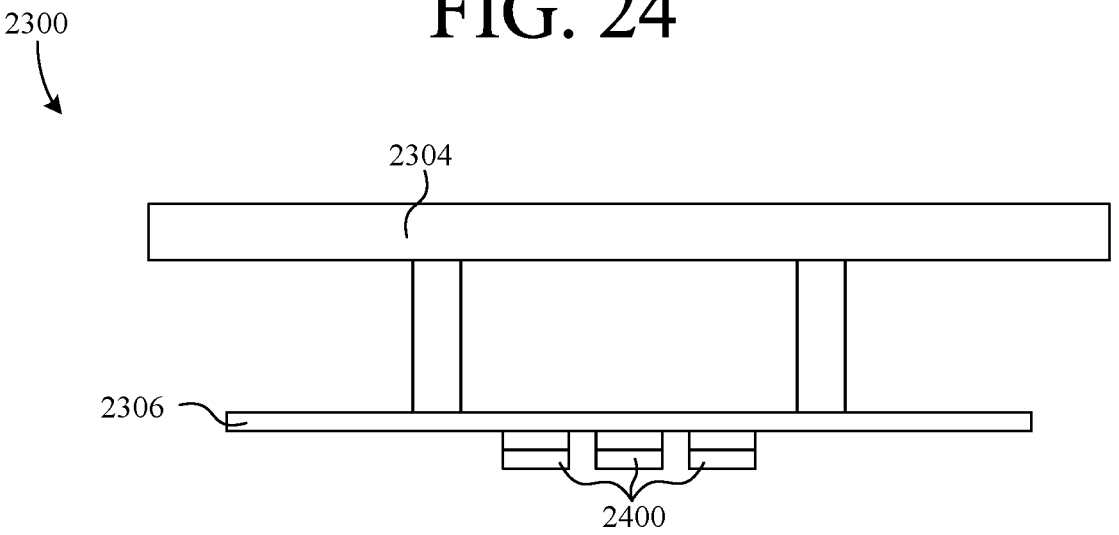
FIG. 25 is a rear plan view of the attachment of FIG. 23.

FIG. 25 shows a rear plan view of attachment 2300.

Figure 26:
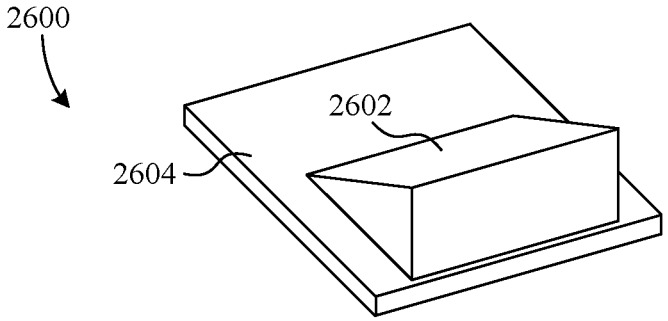
FIG. 26 is a perspective view of another attachment configured to be attached to the accessory of FIG. 21.

FIG. 26 shows a perspective view of an alternate attachment 2600 configured to be removably attached to accessory 2100. Attachment 2600 includes a foot platform 2602 attached to a base 2604. Platform 2602 provides a structure for a user to urge against with their feet during various exercises. Base 2604 facilitates the releasable mounting of attachment 2600 to accessory 2100.

Figure 27:
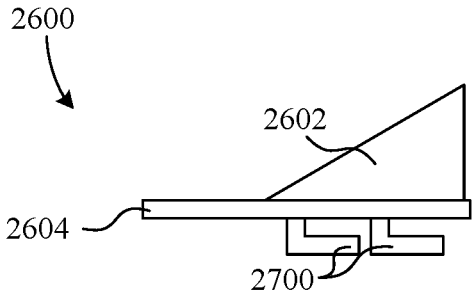
FIG. 27 is a side plan view of the attachment of FIG. 26.

FIG. 27 shows a side plan view of attachment 2600. As shown, base 2604 includes a plurality of protrusions 2700 configured to mate with slots 2106 of accessory 2100 to facilitate the removable coupling of attachment 2600 to accessory 2100. Attachment 2600 mounts to accessory 2100 by disposing each of protrusions 2700 into a respective one of slots 2106 and then sliding attachment 2600 horizontally with respect to accessory 2100.

Figure 28:
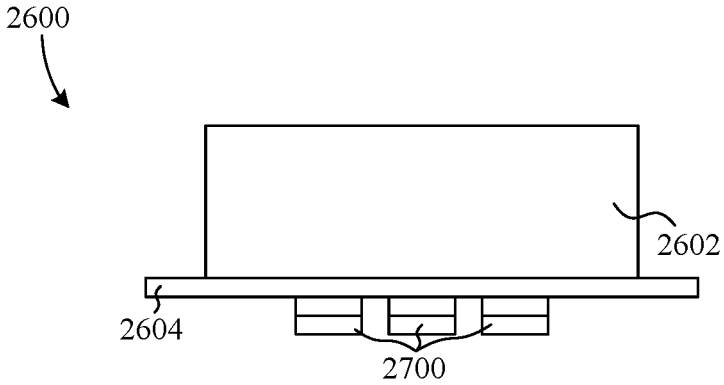
FIG. 28 is a rear plan view of the attachment of FIG. 26.

FIG. 28 shows a rear plan view of attachment 2600.

Figure 29:
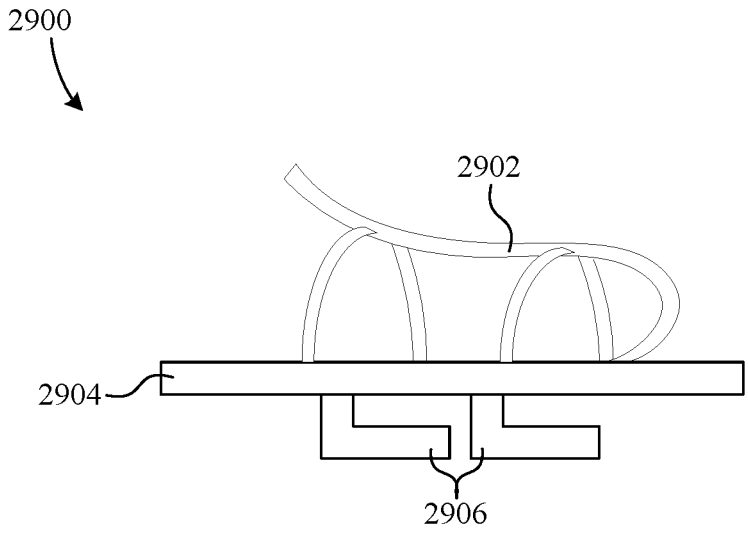
FIG. 29 is a side plan view of another attachment configured to be attached to the accessory of FIG. 21.

FIG. 29 shows a side view of an alternate attachment 2900 configured to be removably attached to accessory 2100. Attachment 2900 includes a foot harness 2902 attached to a base 2904. Harness 2902 is configured to secure the foot of a user to base 2904 during various exercises. Base 2904 facilitates the releasable mounting of attachment 2900 to accessory 2100. Further, base 2904 includes a plurality of protrusions 2906 configured to mate with slots 2106 of accessory 2100 to facilitate the removable coupling of attachment 2900 to accessory 2100. Attachment 2900 mounts to accessory 2100 by disposing each of protrusions 2906 into a respective one of slots 2106 and then sliding attachment 2900 horizontally with respect to accessory 2100.

Figure 30:
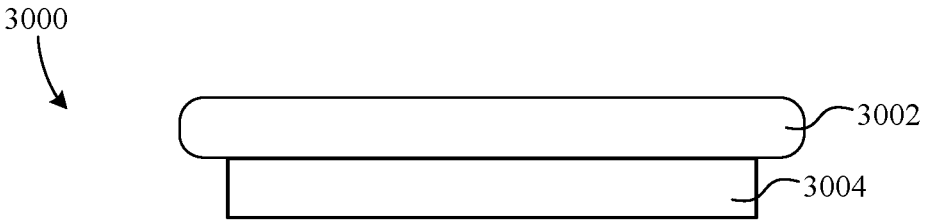
FIG. 30 is a side plan view of bench configured to be attached to a rowing machine.

FIG. 30 shows a side view of a bench 3000 configured to be removably coupled to machine 100. Bench 3000 includes a cushioned top 3002 and a bottom frame 3004. Cushioned top 3002 provides a soft surface for a user to perform various exercises on. Frame 3004 is configured to engage (e.g., fit closely over, rest upon, lock onto, etc.) guide rail 120 when bench 3000 is coupled to machine 100.

Figure 31:
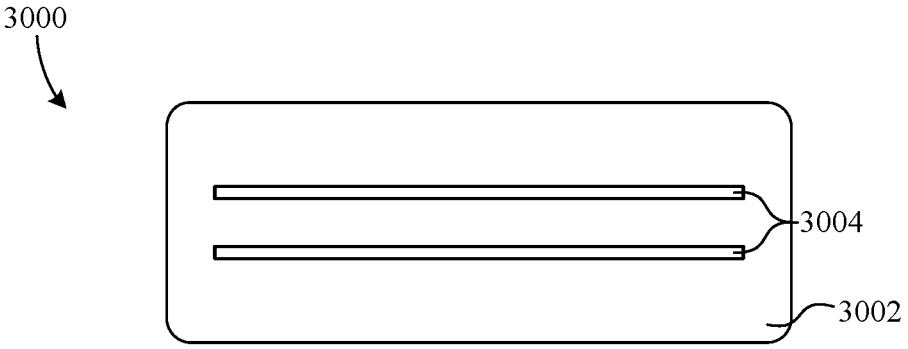
FIG. 31 is a bottom plan view of the bench of FIG. 30.

FIG. 31 shows a bottom view of bench 3000. As shown, frame 3004 includes two parallel rails that are spaced apart to engage the side surfaces of rail 120.

Figure 32:
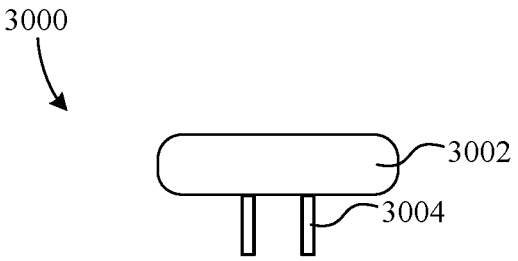
FIG. 32 is a rear plan view of the bench of FIG. 30.

FIG. 32 is a front view of bench 1100.

Figure 33:
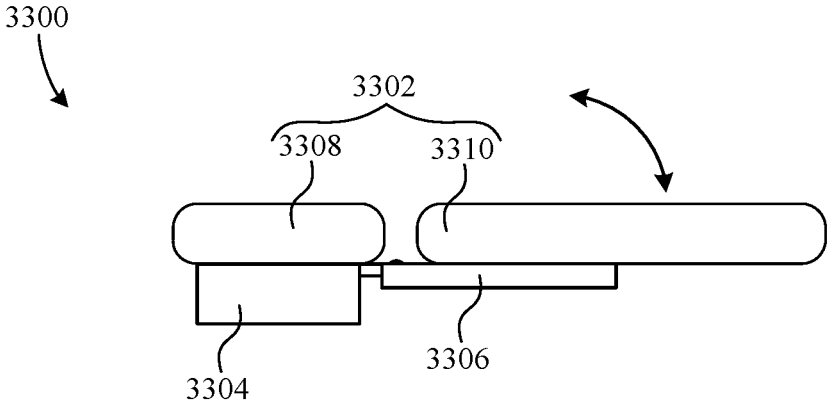
FIG. 33 is a side plan view of another bench configured to be attached to a rowing machine.

FIG. 33 shows a perspective view of another example bench 3300 configured to be removably coupled to machine 100. Bench 3300 includes a cushioned top 3302 and a bottom frame 3304. Cushion top 3302 provides a soft surface for a user to perform various exercises on. Frame 3304 is configured to engage guide rail 120 when bench 3300 is coupled to machine 100. Bench 3300 is substantially similar to bench 3000 but further includes a mechanism 3306 for adjusting the incline of at least a portion of cushioned top 3302. As shown, cushioned top 3302 includes a seat portion 3308 and a back/chest engaging portion 3310.

Figure 34:
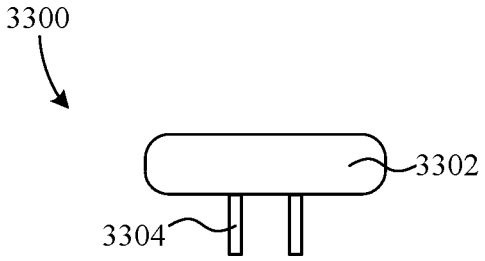
FIG. 34 is a rear plan view of the bench of FIG. 33.

FIG. 34 shows a front view of bench 3300.

Figure 35:
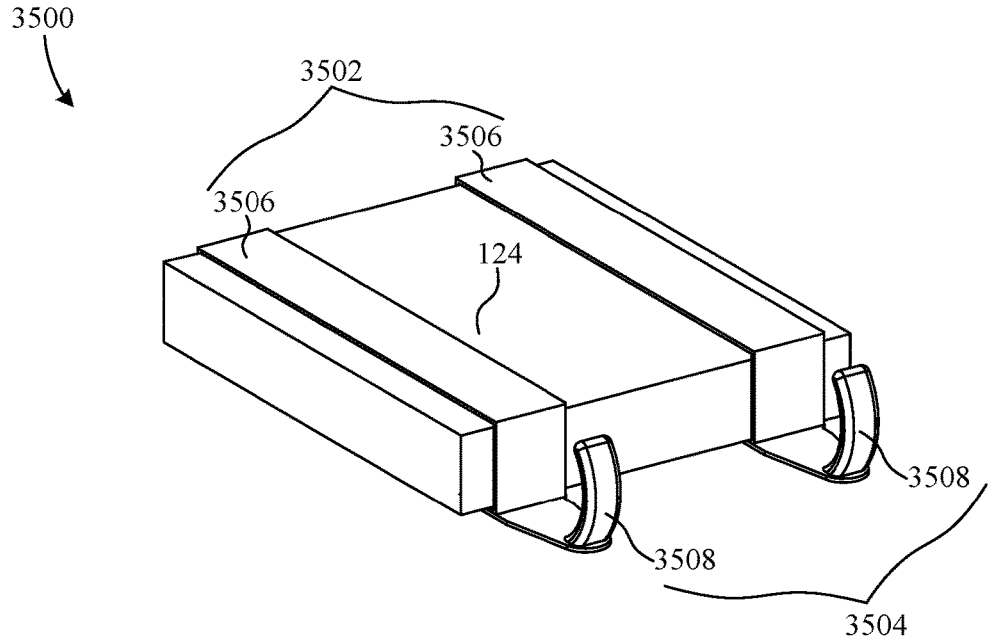
FIG. 35 is a perspective view of an alternate rowing machine attachment mounted on a rowing machine seat.

FIG. 35 shows a perspective view of a rowing machine attachment 3500 removably coupled to seat 124 of rowing machine 100 according to another embodiment. Attachment 3500 facilitates the removable attachment of handle 116 to seat 124. When cable 104 is coupled to roller assembly 106, the resistance from module 112 is imparted on seat 124 when roller assembly 106 is moved away from module 112 along rail 120. Attachment 3500 includes a bracket assembly 3502 that is attached directly to a receiver assembly 3504.

Bracket assembly 3502 includes a set of closed-loops 3506 that are configured to engage opposite sides of seat 124. To remove bracket assembly 3502 from seat 124, the user slides closed-loops 3506 horizontally away from one another, along axis A-A of FIG. 36.

Receiver assembly 3504 includes a set of hooks 3508, each attached to a respective one of closed-loops 3506. Hooks 3508 provide the same functionality as hooks 310 of receiver 302. Accordingly, receiver assembly 3504 is also configured to receive handle 116 of rowing machine 100 so as to impart the resistive force from module 112 directly to roller assembly 106 through cable 104. When handle 116 is engaged by hooks 3508 of receiver assembly 3504, roller assembly 106 resists moving away from module 112 along rail 120. In this example, left and right hooks 3508 are each configured to engage a respective left and right grip of handle 116.

Figure 36:
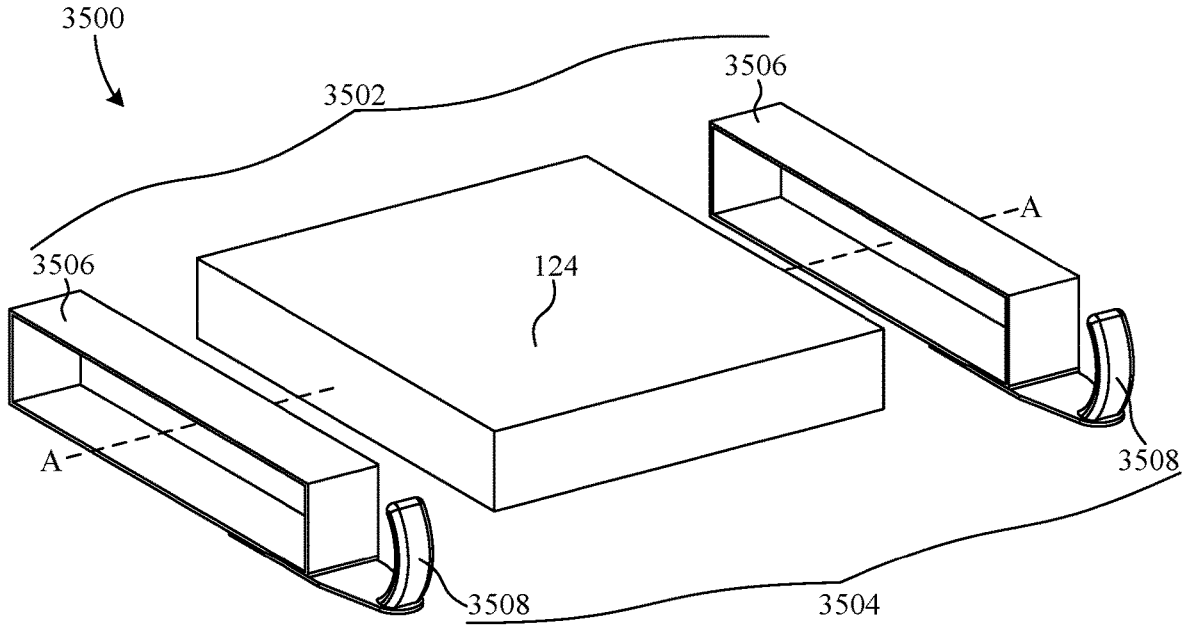
FIG. 36 is a perspective view of the rowing machine attachment of FIG. 35 exploded from the rowing machine seat.

FIG. 36 shows a perspective view of rowing machine attachment 3500 removed from seat 124. To couple bracket assembly 3502 to seat 124, the user slides closed-loops 3506 horizontally toward one another along axis A-A from opposite sides of seat 124.

Figure 37:
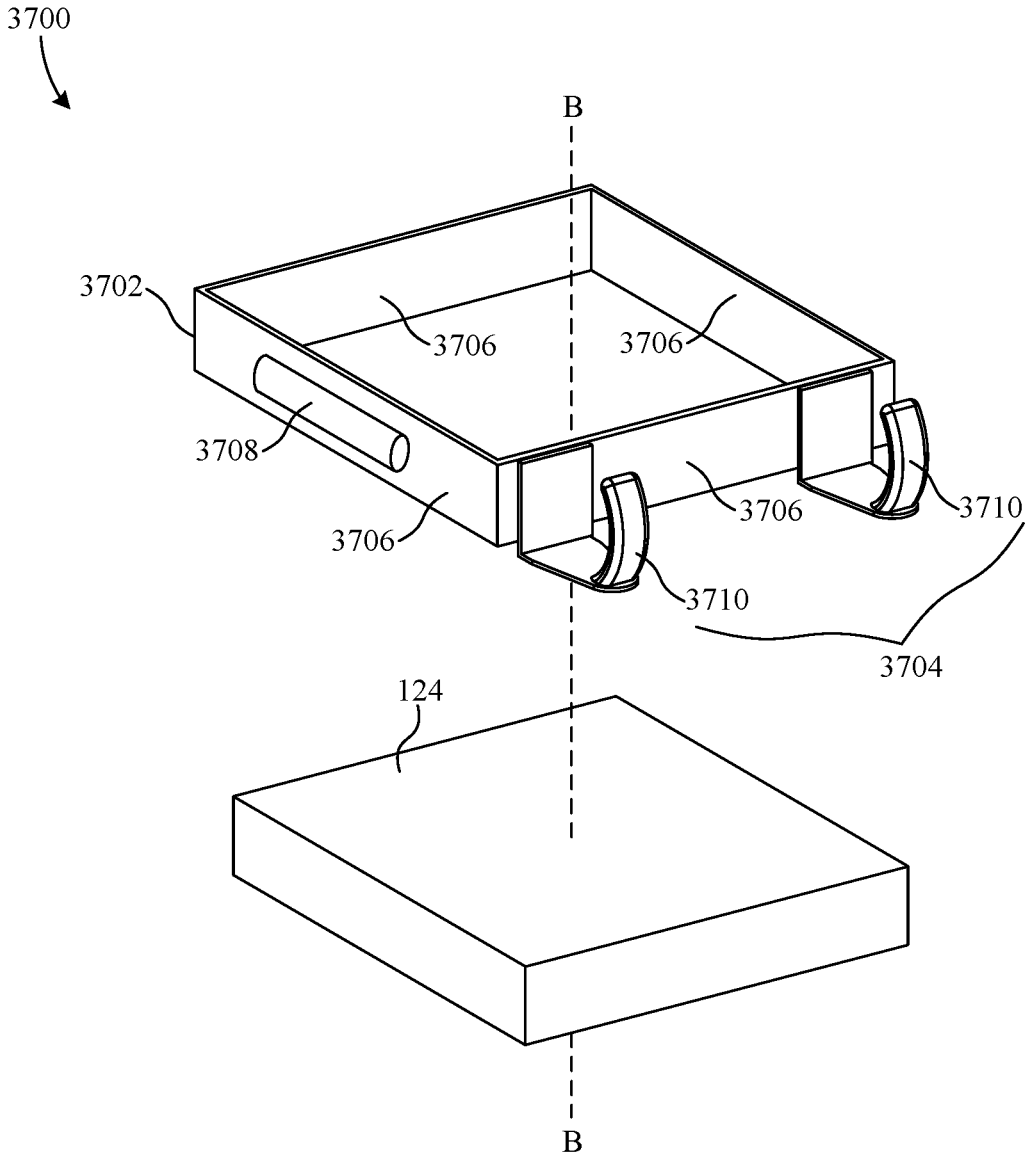
FIG. 37 is a perspective view of an alternate rowing machine attachment exploded from a rowing machine seat.

FIG. 37 shows a top perspective view of a rowing machine attachment 3700 according to yet another alternate embodiment. Attachment 3700 is configured to be mounted to roller assembly 106 so that cable 104 can be removably coupled thereto. When cable 104 is coupled to roller assembly 106, the resistance from module 112 is imparted on seat 124 when roller assembly 106 is moved away from module 112 along rail 120. Attachment 3700 includes a bracket 3702 that is attached directly to a receiver 3704.

Bracket 3702 facilitates the mounting of attachment 3700 to roller assembly 106. Bracket 3702 includes a plurality of sidewalls 3706 configured to be disposed around the four peripheral edges of seat 124. Bracket 3702 further includes a set two handles 3708 (only one shown), each connected to an opposite side of sidewalls 3706.

Receiver 3704 includes a set of hooks 3710 attached to sidewalls 3706. Hooks 3710 are configured to receive handle 116 of rowing machine 100 so as to impart the resistive force from module 112 directly to roller assembly 106 through cable 104. When handle 116 is engaged by hooks 3710, roller assembly 106 resists moving away from module 112 along rail 120. In this example, left and right hooks 3710 are each configured to engage a respective left and right grip of handle 116.

To couple bracket 3702 to seat 124, the user slides sidewalls 3706 vertically down around the peripheral sides of seat 124 along axis B-B.

Figure 38:
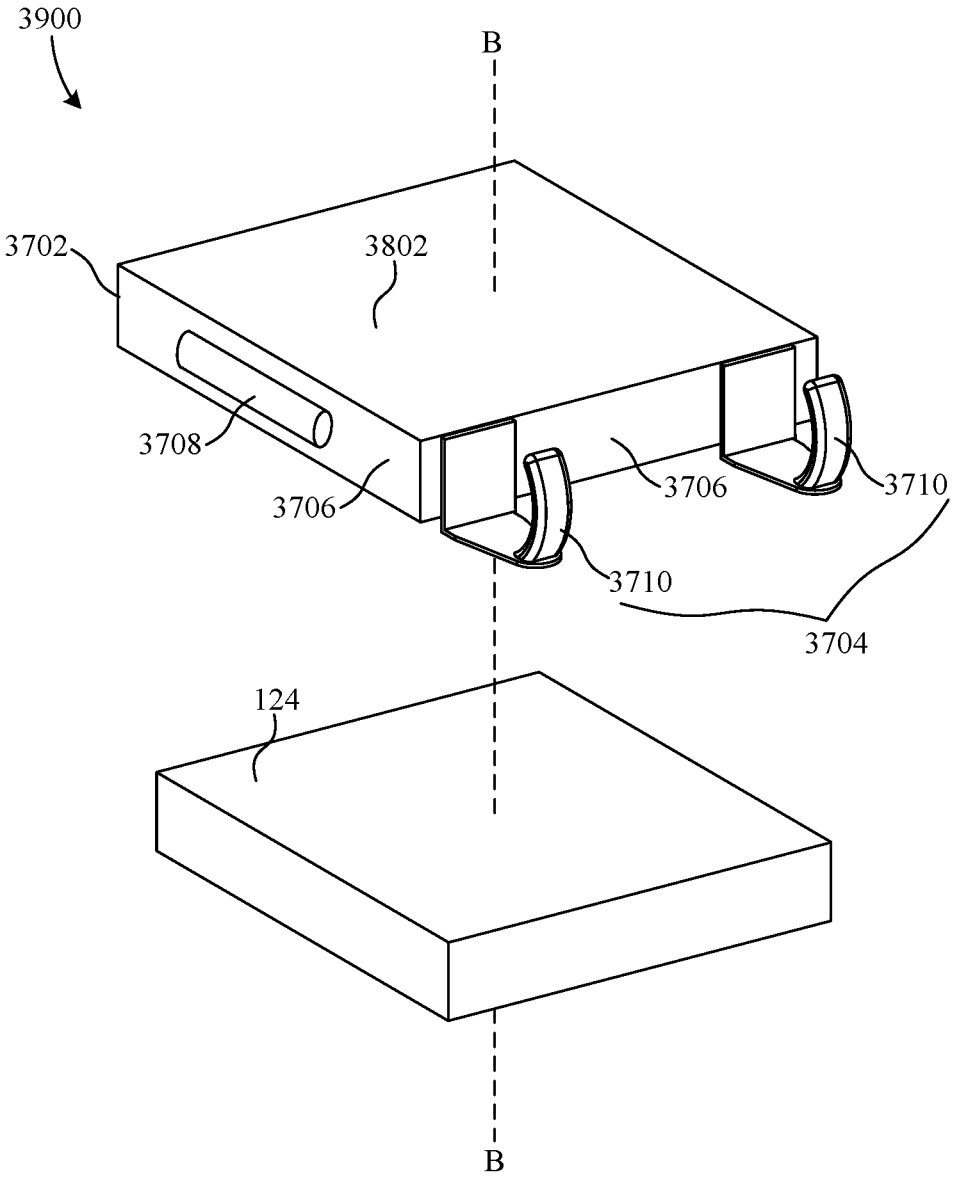
FIG. 38 is a perspective view of an alternate rowing machine attachment exploded from a rowing machine seat.

FIG. 38 shows a top perspective view of a rowing machine attachment 3800 according to yet another alternate embodiment. Attachment 3800 is configured to be mounted to roller assembly 106 so that cable 104 can be removably coupled thereto. When cable 104 is coupled to roller assembly 106, the resistance from module 112 is imparted on seat 124 when roller assembly 106 is moved away from module 112 along rail 120. Attachment 3800 is substantially similar to attachment 3700, the only difference being that attachment 3800 further includes a top wall 3802 that abuts the top of seat 124. Essentially, top wall 3802 is the top of a box structure having four rigid sidewalls, a rigid top wall 3802 and an open bottom. Therefore, like elements will be denoted by like reference numbers and withheld from the following description.

Figure 39:
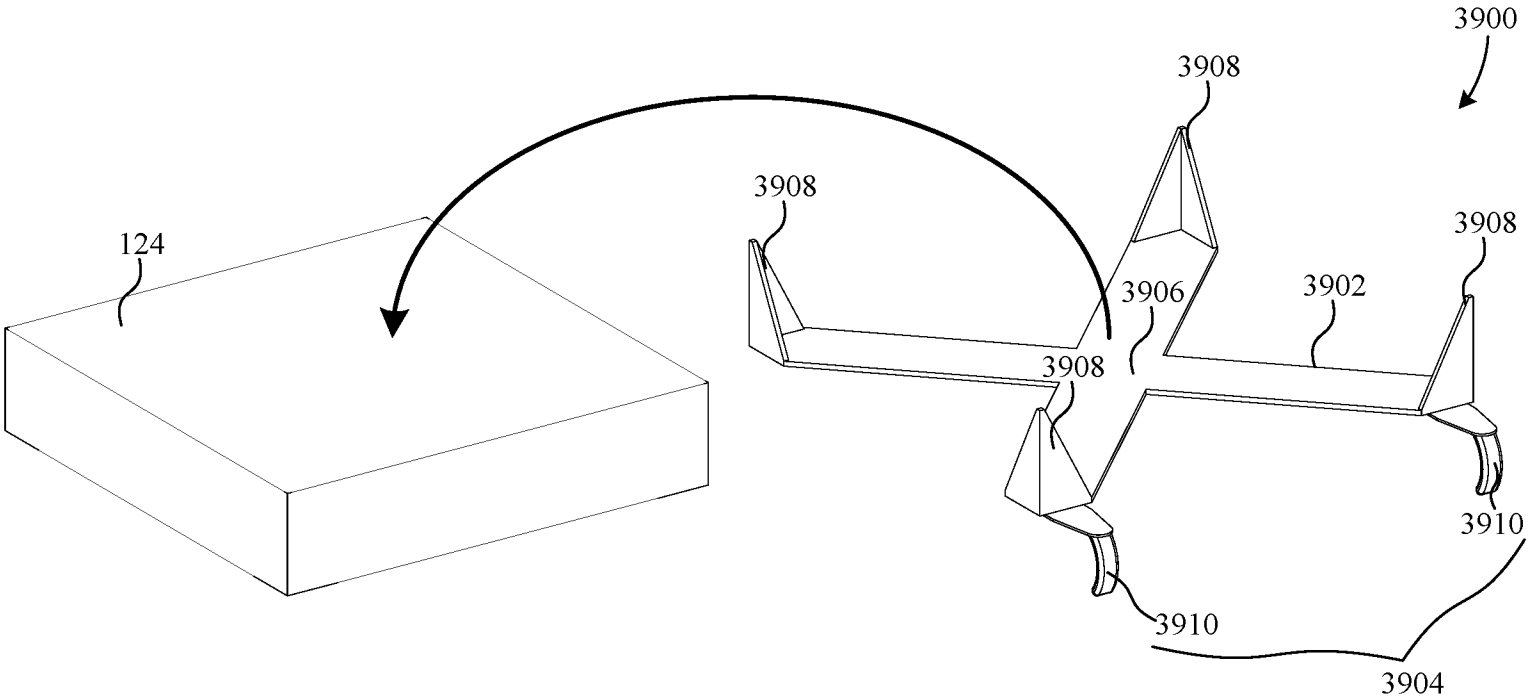
FIG. 39 is a perspective view of an alternate rowing machine attachment exploded from a rowing machine seat.

FIG. 39 shows a top perspective view of a rowing machine attachment 3900 according to yet another alternate embodiment. Attachment 3900 is configured to be removably mounted to seat 124 so that cable 104 can be removably coupled to roller assembly 106. When cable 104 is coupled to roller assembly 106, the resistance from module 112 is imparted on seat 124 when roller assembly 106 is moved away from module 112 along rail 120. Attachment 3900 includes a bracket 3902 that is attached directly to a receiver 3904.

Bracket 3902 is configured to be placed directly over seat 124. Bracket 3902 includes an X-shaped plate 3906 having a plurality of square-edged protrusions 3908 extending perpendicularly therefrom. Each one of protrusions 3908 is adapted to engage a respective side corner of seat 124. When bracket 3902 is disposed on seat 124, bracket 3902 maintains a fixed position relationship with seat 124 as slider assembly 106 moves along rail 120. Removing attachment 3900 from seat 124 simply entails lifting bracket 3902 off of seat 124.

Receiver 3904 includes a set of hooks 3910 attached to bracket 3902. Hooks 3910 are configured to receive handle 116 of rowing machine 100 so as to impart the resistive force from module 112 directly to roller assembly 106 through cable 104. When handle 116 is engaged by hooks 3910, roller assembly 106 resists moving away from module 112 along rail 120. In this example, left and right hooks 3910 are each configured to engage a respective left and right grip of handle 116.

Figure 40:
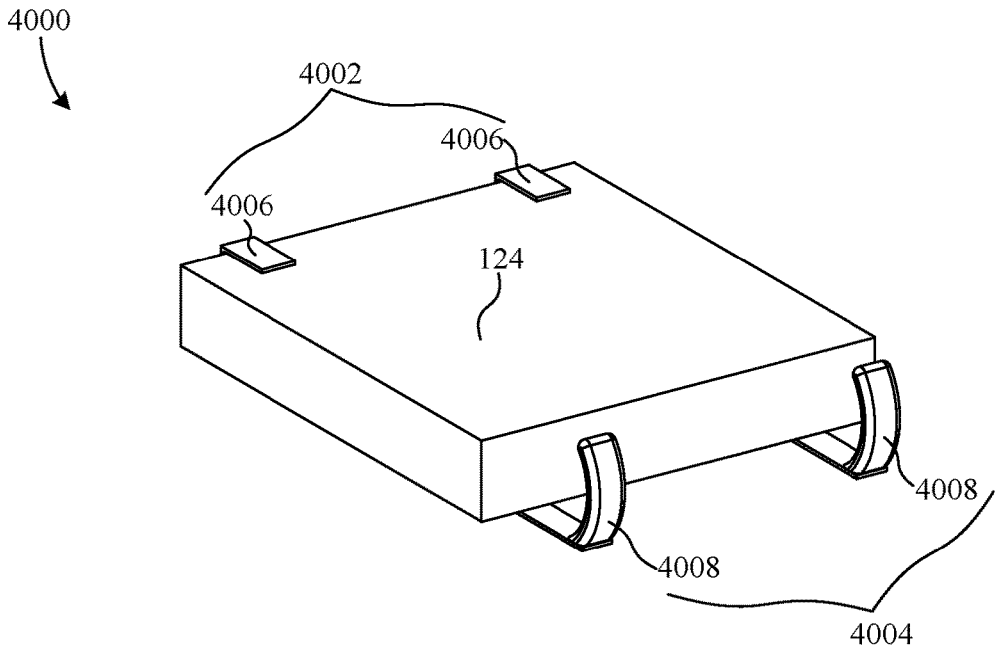
FIG. 40 is a perspective view of an alternate rowing machine attachment mounted on a rowing machine seat.

FIG. 40 shows a perspective view of a rowing machine attachment 4000 removably coupled to seat 124 of rowing machine 100 according to another embodiment. Attachment 4000 facilitates the removable attachment of handle 116 to seat 124. When cable 104 is coupled to roller assembly 106, the resistance from module 112 is imparted on seat 124 when roller assembly 106 is moved away from module 112 along rail 120. Attachment 4000 includes a bracket assembly 4002 that is attached directly to a receiver assembly 4004.

Bracket assembly 4002 includes a set of hooks 4006 that are configured to engage the rear of seat 124 from opposite sides of seat 124. To remove bracket assembly 4002 from seat 124, the user slides hooks 4006 horizontally away from one another, along axis C-C of FIG. 41.

Receiver assembly 4004 includes a second set of hooks 4008, each attached to a respective one of hooks 4006. Hooks 4008 provide the same functionality as hooks 310 of receiver 302. Accordingly, receiver assembly 4004 is also configured to receive handle 116 of rowing machine 100 so as to impart the resistive force from module 112 directly to roller assembly 106 through cable 104. When handle 116 is engaged by hooks 4008 of receiver assembly 4004, roller assembly 106 resists moving away from module 112 along rail 120. In this example, left and right hooks 4008 are each configured to engage a respective left and right grip of handle 116.

Figure 41:
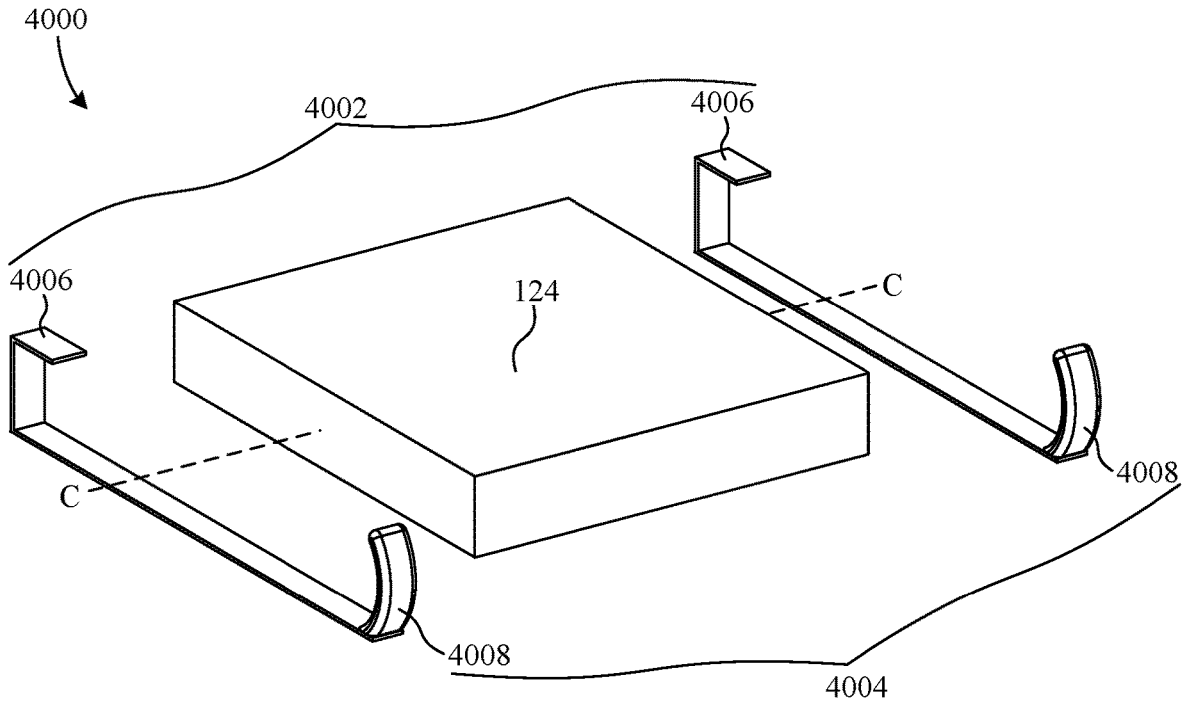
FIG. 41 is a perspective view of the rowing machine attachment of FIG. 40 exploded from a rowing machine seat.

FIG. 41 shows a perspective view of rowing machine attachment 4000 removed from seat 124. To couple bracket assembly 4002 to seat 124, the user slides hooks 4006 horizontally toward one another along axis C-C from opposite sides of seat 124.

Figure 42:
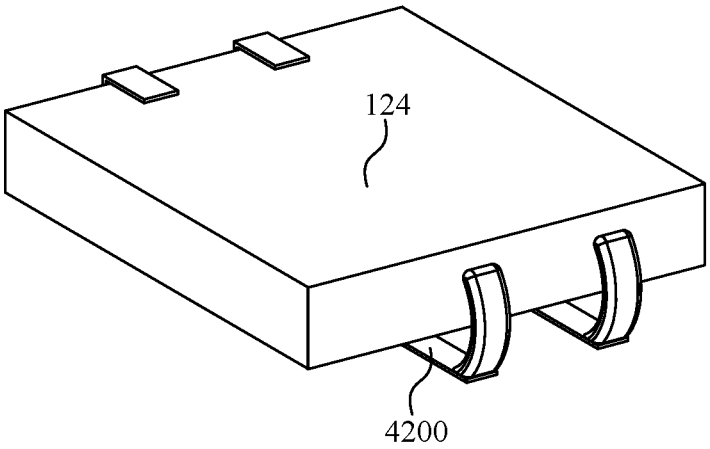
FIG. 42 is a perspective view of an alternate rowing machine attachment mounted on a rowing machine seat.

FIG. 42 shows a perspective view of a rowing machine attachment 4200 removably coupled to seat 124 of rowing machine 100 according to another embodiment. Attachment 4200 facilitates the removable attachment of handle 116 to seat 124. When cable 104 is coupled to roller assembly 106, the resistance from module 112 is imparted on seat 124 when roller assembly 106 is moved away from module 112 along rail 120.

Figure 43:
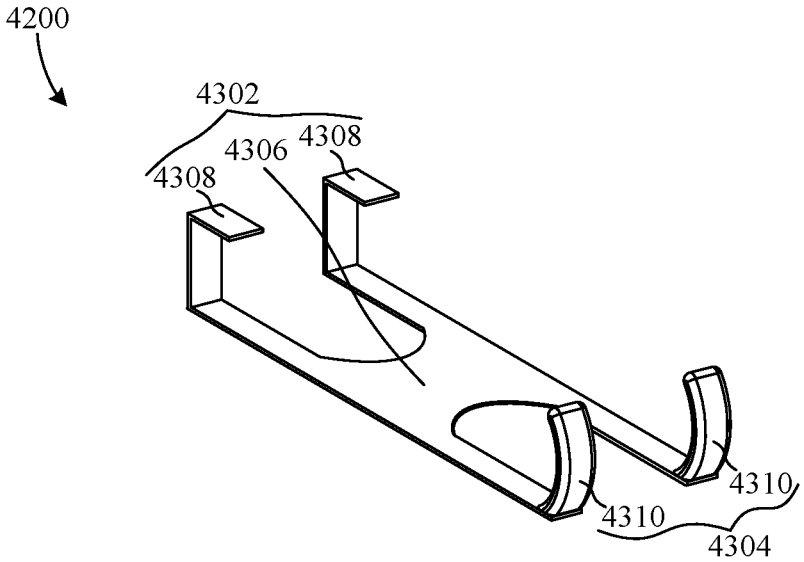
FIG. 43 is a perspective view of the rowing machine attachment of FIG. 42.

FIG. 43 shows a perspective view of attachment 4200 removed from seat 124. Attachment 4200 includes a bracket 4302 that is attached directly to a receiver 4304.

Bracket 4302 includes an H-shaped plate 4306 and a set of hooks 4308. Hooks 4308 are configured to both engage the back of seat 124. Bracket 4302 is configured to be fixably mounted to roller assembly 106 by first removing the screws (not shown) that secure seat 124 to the rest of roller assembly 106. Then, bracket 4302 is positioning between seat 124 and the rest of roller assembly 106 with receiver 4304 being disposed in the front of seat 124, between seat 124 and module 112. Finally, the four screws of roller assembly 106 are tightened, thereby sandwiching bracket 4302 between seat 124 and the rest of roller assembly 106 such that hooks 4308 engage the back of seat 124. Accordingly, bracket 4302 remains fixed with respect to roller assembly 106 as roller assembly 106 moves along rail 120.

Receiver 4304 includes a set of hooks 4310 configured to receive handle 116 of rowing machine 100 so as to impart the resistive force from module 112 directly to roller assembly 106 through cable 104. Indeed, when handle 116 is engaged by hooks 4310 of receiver 4304, roller assembly 106 resists moving away from module 112 along rail 120. In this example, left and right hooks 4310 are each configured to engage a respective left and right grip of handle 116.

Figure 44:
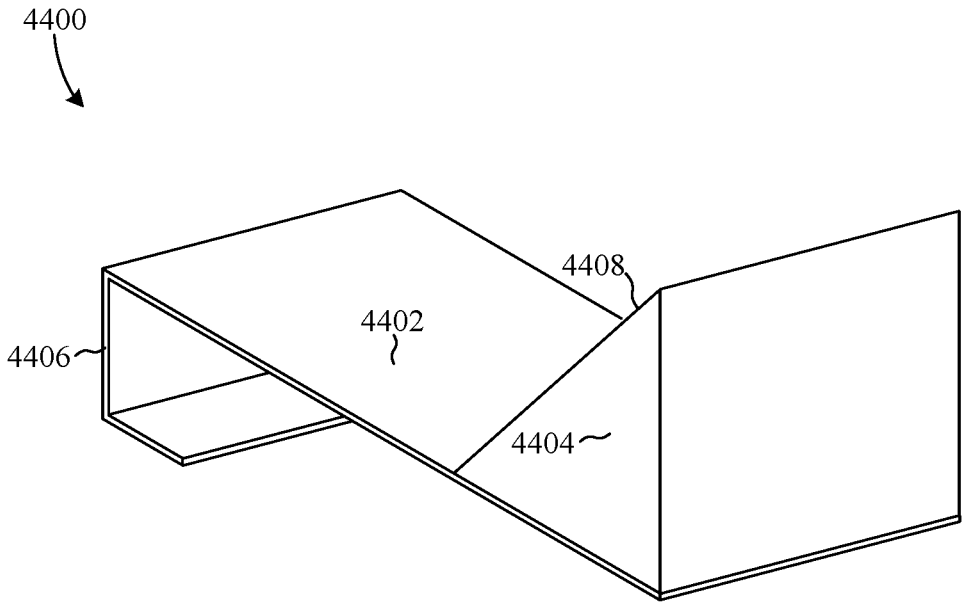
FIG. 44 is a perspective view of an alternate rowing machine attachment.

FIG. 44 shows a perspective view of a rowing machine attachment 4400 according to another embodiment. Attachment 4400 is adapted to quickly attach to, and detach from, seat 124 of rowing machine 100. Attachment 4400 allows a user to move seat 124 along rail 120 using one or more feet. Depending on the particular exercise, attachment 4400 may be used in conjunction with any of the previously described attachments that couple cable 104 to seat 124 if resistance in moving roller assembly 106 along rail 120 is desired. If no resistance is desired, attachment 4400 may be used when cable 104 is not coupled to seat 124.

Attachment 4400 includes a bracket 4402 and a foot platform 4404. Bracket 4402 is a rigid structure that is adapted to engage seat 124. More specifically, bracket 4402 includes a hook 4406 that is configured to engage the front portion of seat 124 such that hook 4406 pulls seat 124 away from module 112 along rail 120 when horizontal force is exerted on platform 4404. Platform 4404 is fixed to bracket 4402 and includes an angled supporting surface 4408 onto which the user's foot urges during use.

Figure 45:
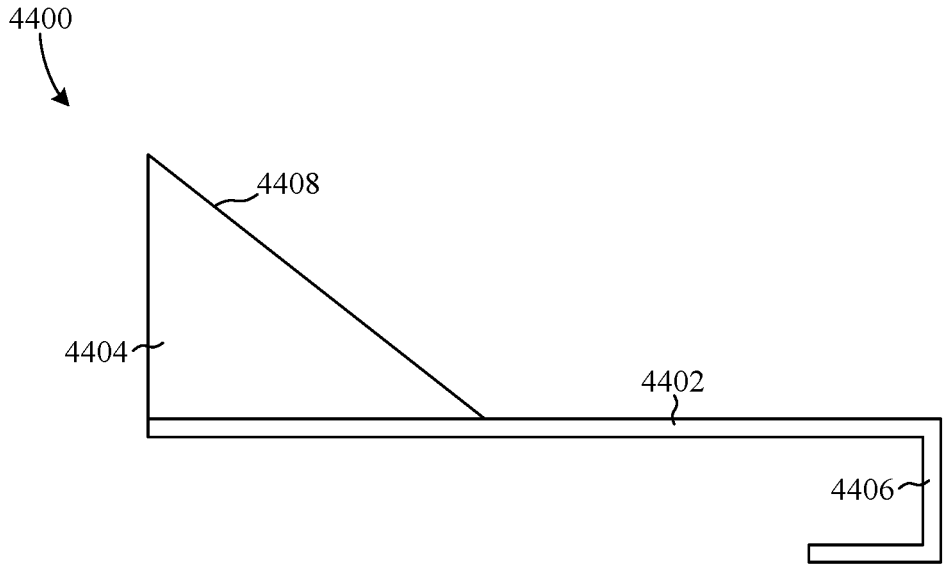
FIG. 45 is a side plan view of the rowing machine attachment of FIG. 44.

FIG. 45 shows a side plan view of rowing machine attachment 4400.

Figure 46:
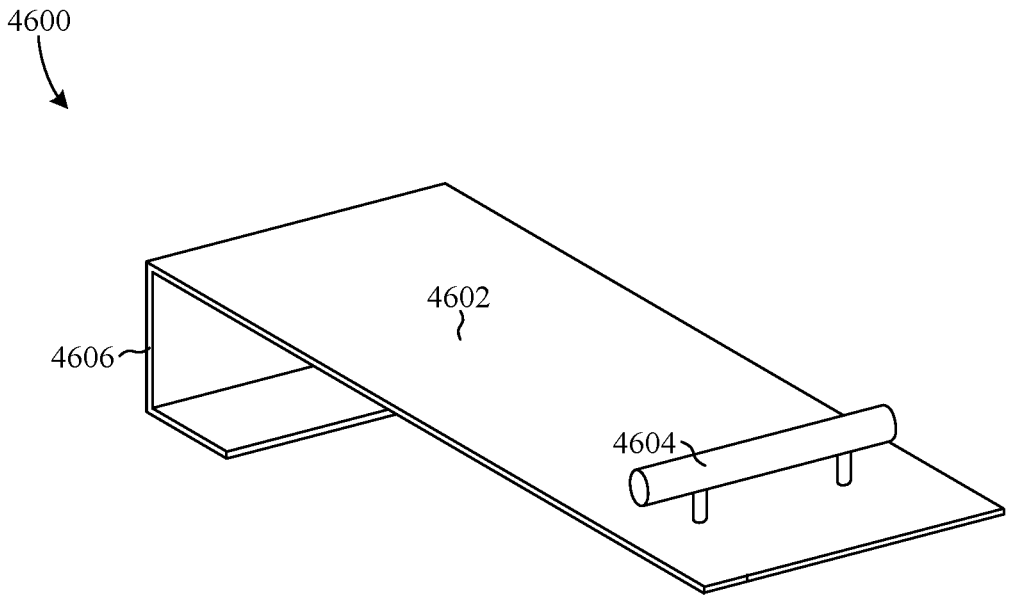
FIG. 46 is a perspective view of an alternate rowing machine attachment.

FIG. 46 shows a perspective view of a rowing machine attachment 4600 according to another embodiment. Attachment 4600 is adapted to quickly attach to, and detach from, seat 124 of rowing machine 100. Attachment 4600 allows a user to move seat 124 along rail 120 using one or more hands. Depending on the particular exercise, attachment 4600 may be used in conjunction with any of the previously described attachments that couple cable 104 to seat 124 if resistance in moving roller assembly 106 along rail 120 is desired. If no resistance is desired, attachment 4600 may be used when cable 104 is not coupled to seat 124.

Attachment 4600 includes a bracket 4602 and a handle 4604. Bracket 4602 is a rigid structure that is adapted to engage seat 124. More specifically, bracket 4602 includes a hook 4606 that is configured to engage the front portion of seat 124 such that hook 4606 pulls seat 124 away from module 112 along rail 120 when horizontal force is exerted on handle 4604. Handle 4604 is fixed to bracket 4602.

Figure 47:
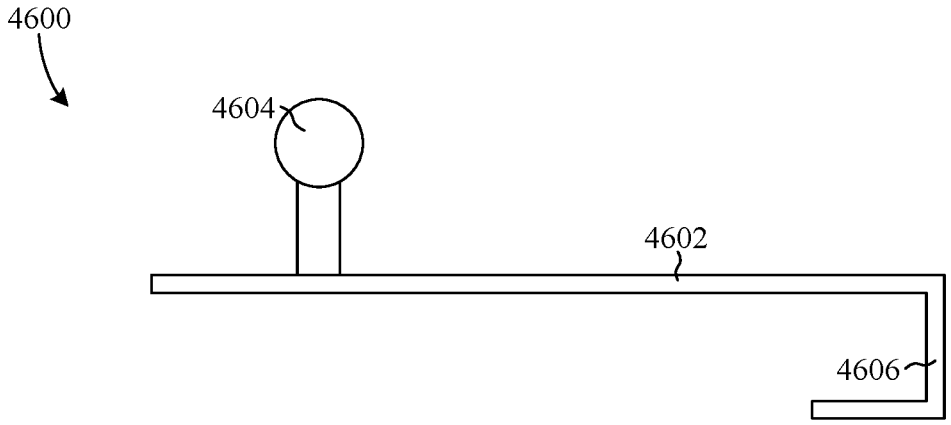
FIG. 47 is a side plan view of the rowing machine attachment of FIG. 46.

FIG. 47 shows a side plan view of rowing machine attachment 4600.

Figure 48:
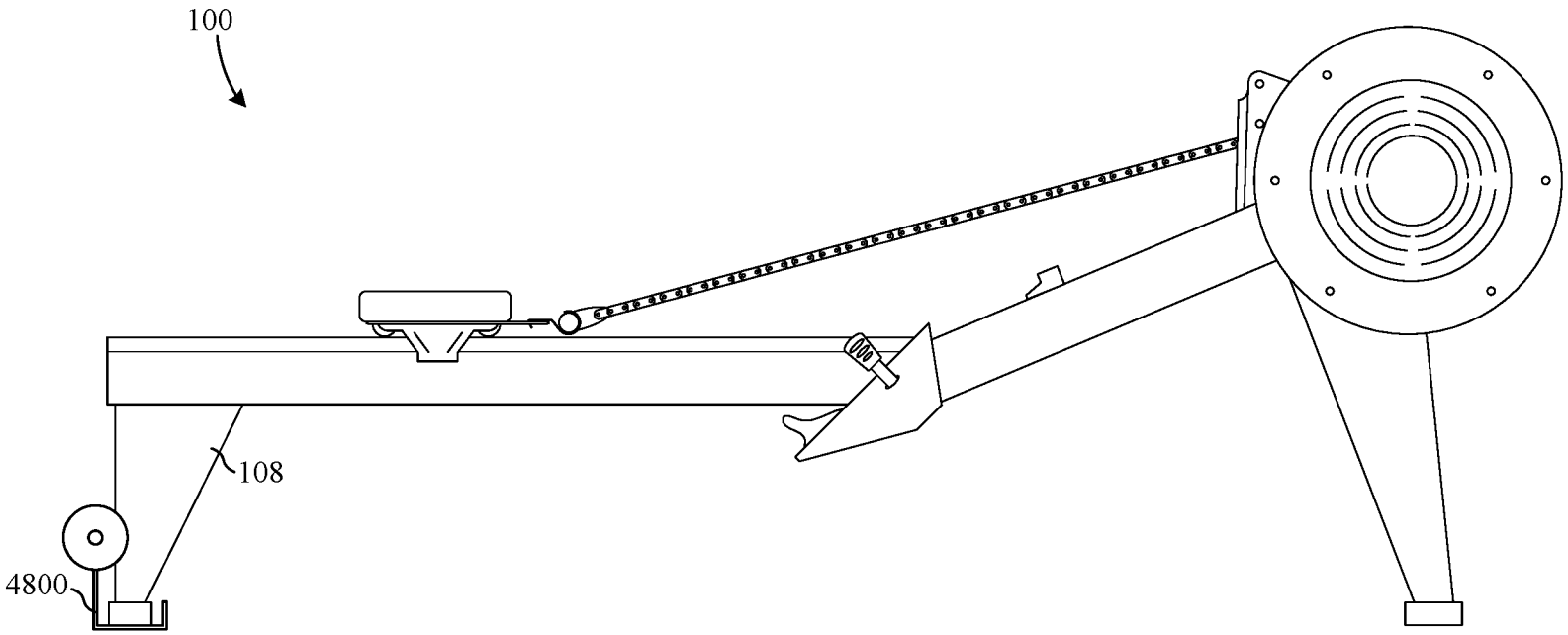
FIG. 48 is a side plan view of an alternate rowing machine attachment coupled to a rowing machine.

FIG. 48 shows a side plan view of a rowing machine attachment 4800, according to another embodiment, coupled to rowing machine 100. Attachment 4800 is adapted to be coupled to the rear support leg 108 of rowing machine 100. This is achieved by lifting the rear support leg 108 off of the underlying surface, positioning attachment 4800 on the underlying surface, and then letting down leg 108, thereby sandwiching attachment 4800 between the foot of leg 108 and the underlying surface (e.g., floor, ground, etc.). Once in place, attachment 4800 can be engaged by a user's feet and/or legs during particular exercises.

Figure 49:
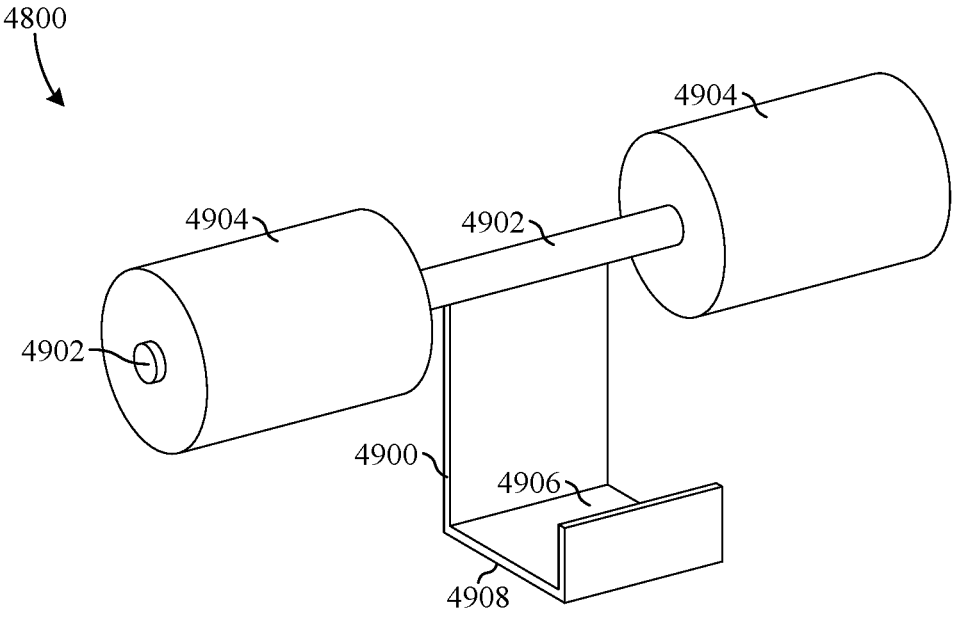
FIG. 49 is a perspective view of the rowing machine attachment of FIG. 48.

FIG. 49 shows a perspective view of rowing machine attachment 4800 removed from rowing machine 100. Attachment 4800 includes a bracket 4900, a bar 4902, and a set of pads 4904.

Bracket 4900 facilitates the mounting of attachment 4800 to machine 100. As shown, bracket 4900 includes an interior surface 4906 and an exterior surface 4908. Interior surface 4906 is adapted to receive the foot of rear support leg 108. Exterior surface 4908 is adapted to abut the underlying supporting surface such as, for example, the floor. When attachment 4800 is disposed between support leg 108 and the underlying supporting surface, attachment 4800 can be urged against by the user's feet and/or legs while maintaining a fixed position relationship with respect machine 100.

Bar 4902 is horizontally disposed member that is rigidly fixed to bracket 4900 to provide support to pads 4904.

Each of pads 4904 is an annular member disposed about bar 4902 to provide padding between the dorsal portions of a user's feet and bar 4902. Pads 4904 are formed from soft, resilient material such as, for example, foam or the like.

Figure 50:
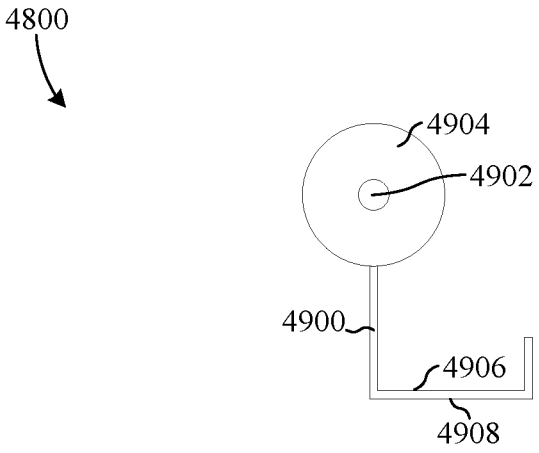
FIG. 50 is a side plan view of the rowing machine attachment of FIG. 49.

FIG. 50 shows a side plan view of rowing machine attachment 4800 removed from rowing machine 100.

Figure 51A:
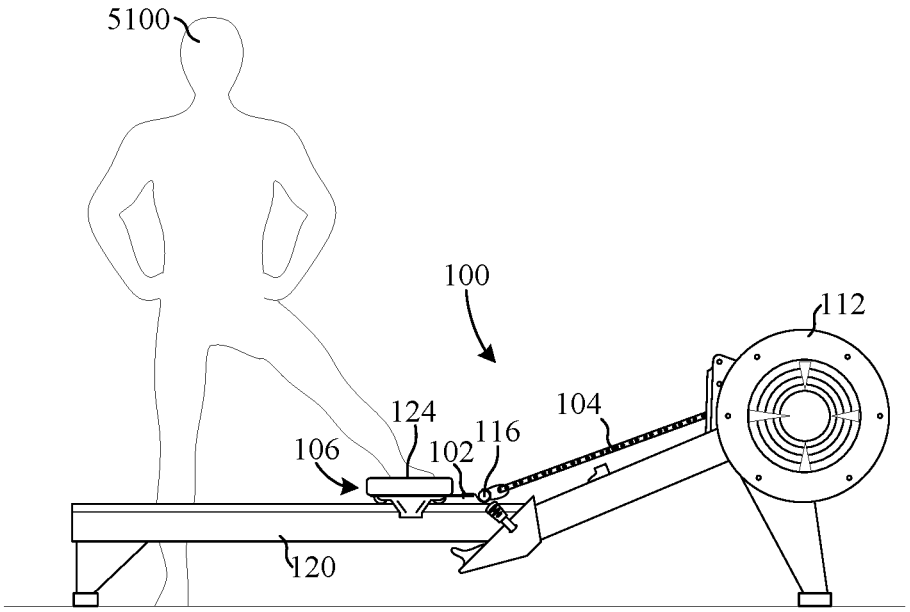
FIG. 51A is a side view of the attachment of FIG. 1 being used by a user in a starting position of a first example exercise.
Figure 51B:
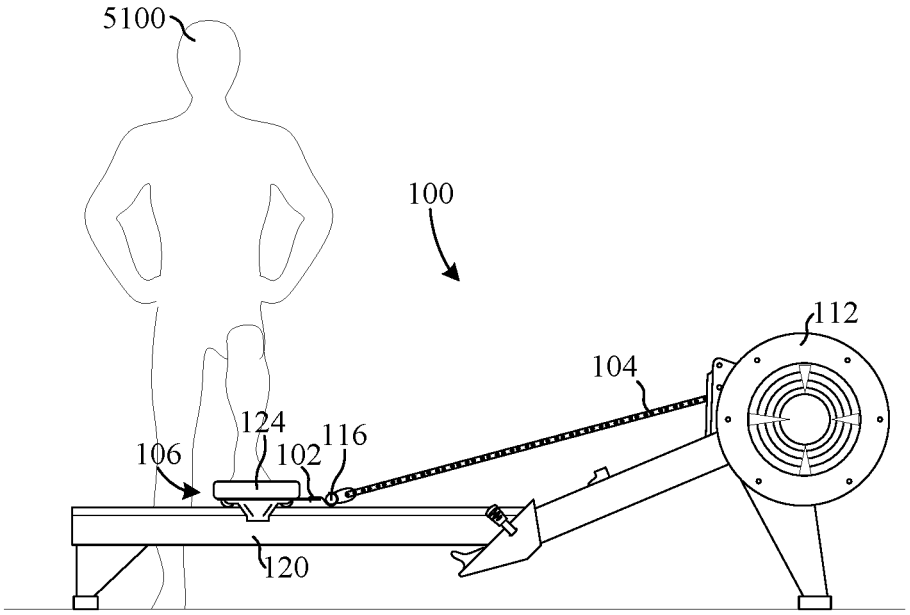
FIG. 51B is a side view of the attachment of FIG. 1 being used by a user in a finishing position of a first example exercise.

FIGS. 51A and 51B illustrate the starting position and the ending position, respectively, of an example exercise, wherein attachment 102 is mounted to roller assembly 106, and handle 116 is coupled to attachment 102. In the starting position, depicted in FIG. 51A, user 5100 stands near the rear of machine 100, facing a direction that is perpendicular to the travel direction of cable 104, with the left foot directly engaging seat 124. Then, user 5100 urges seat 124, and therefore roller assembly 106, away from module 112, along rail 120 until finishing the motion as depicted in FIG. 51B. As roller assembly 106 transitions from the position depicted in FIG. 51A to the position depicted in FIG. 51B, resistance to the motion from module 112 is imparted on roller assembly 106 indirectly through cable 104 and attachment 102.

Figure 52A:
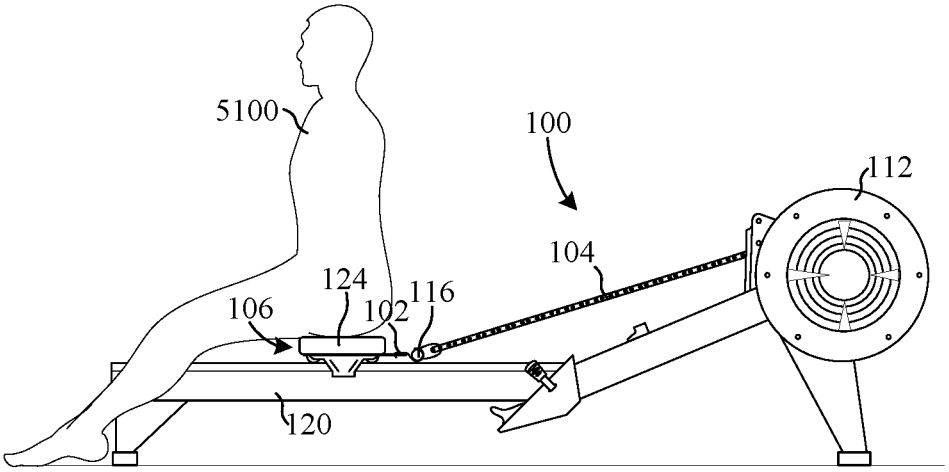
FIG. 52A is a side view of the attachment of FIG. 1 being used by a user in a starting position of a second example exercise.
Figure 52B:
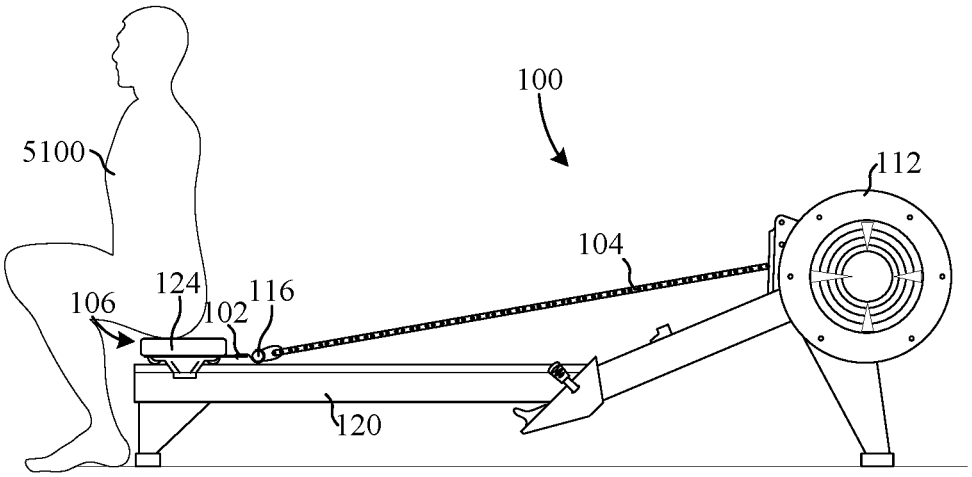
FIG. 52B is a side view of the attachment of FIG. 1 being used by a user in a finishing position of a second example exercise.

FIGS. 52A and 52B illustrate the starting position and the ending position, respectively, of another example exercise, wherein attachment 102 is mounted to roller assembly 106, and handle 116 is coupled to attachment 102. In the starting position, depicted in FIG. 52A, user 5100 sits on seat 124 in a rear-facing position, with one or more legs extended. Then, user 5100 urges seat 124, and therefore roller assembly 106, away from module 112, along rail 120 by bending one or more legs at the knee until finishing the motion as depicted in FIG. 52B. As roller assembly 106 transitions from the position depicted in FIG. 52A to the position depicted in FIG. 52B, resistance to the motion from module 112 is imparted on roller assembly 106 indirectly through cable 104 and attachment 102.

Figure 53A:
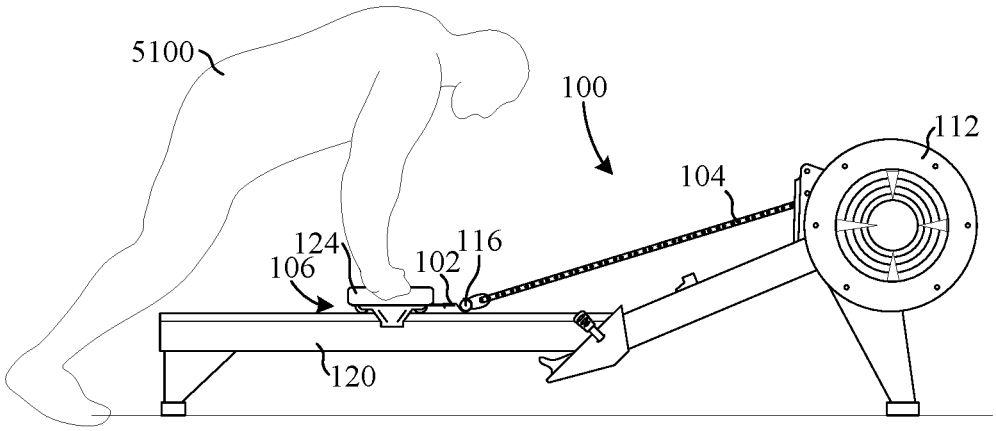
FIG. 53A is a side view of the attachment of FIG. 1 being used by a user in a starting position of a third example exercise.
Figure 53B:
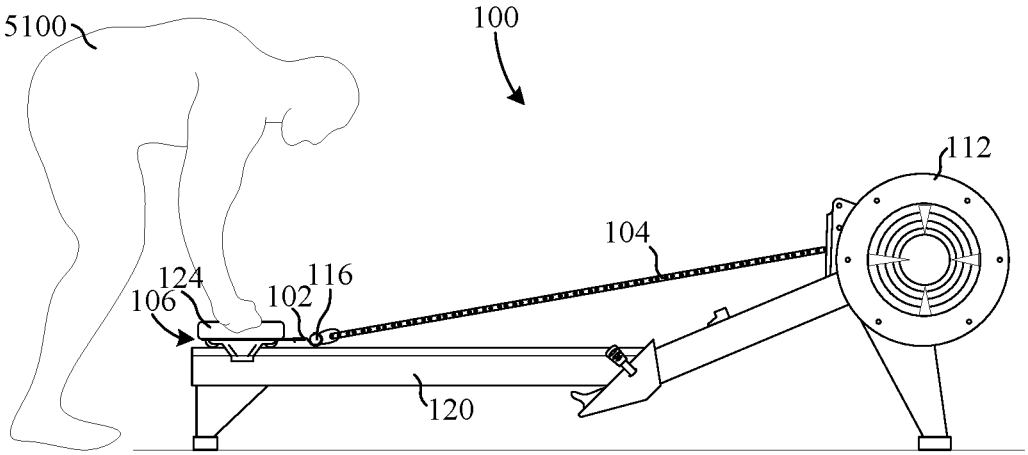
FIG. 53B is a side view of the attachment of FIG. 1 being used by a user in a finishing position of a third example exercise.

FIGS. 53A and 53B illustrate the starting position and the ending position, respectively, of another example exercise, wherein attachment 102 is mounted to roller assembly 106, and handle 116 is coupled to attachment 102. In the starting position, depicted in FIG. 53A, user 5100 stands at the rear of machine, leans forward in a forward-facing position, and grabs seat 124 with both hands. Then, user 5100 urges seat 124, and therefore roller assembly 106, away from module 112, along rail 120 by pulling seat 124 towards the rear of machine 100 until finishing the motion as depicted in FIG. 53B. As roller assembly 106 transitions from the position depicted in FIG. 53A to the position depicted in FIG. 52B, resistance to the motion from module 112 is imparted on roller assembly 106 indirectly through cable 104 and attachment 102.

The description of particular embodiments of the present invention is now complete. Many of the described features may be substituted, altered or omitted without departing from the scope of the invention. For example, alternate cable types (e.g., chains, steel cable, belts, etc.), may be substituted for cable 104. As another example, alternate styles of rowing machines may be substituted for the rowing machine 100. These and other deviations from the particular embodiments shown will be apparent to those skilled in the art, particularly in view of the foregoing disclosure.

I claim:

1. A rowing machine comprising:

a cable having a first end connected to a resistance module and an opposite distal end;

a handle having a first portion, a second portion, and an intermediate portion, said first portion of said handle being configured to be grasped by a user's first hand, said second portion of said handle being configured to be grasped by said user's second hand, said intermediate portion of said handle being disposed between said first portion of said handle and said second portion of said handle, said intermediate portion being attached to said distal end of said cable;

a frame;

a roller assembly movable along said frame;

a seat movably coupled to said frame;

a first receiver fixed with respect to said seat, said first receiver being configured to selectively receive said first portion of said handle; and a second receiver fixed with respect to said seat, said second receiver being configured to selectively receive said second portion of said handle; and wherein said first receiver and said second receiver are rigidly affixed to said seat by at least a first fastener;

said first receiver and said second receiver are integral parts of a bracket;

said bracket includes a plate defining a first fastener passage;

said first fastener is disposed through said first fastener passage of said plate of said bracket;

said seat is fixedly attached to said roller assembly by said first fastener; and said plate is fixedly disposed between said roller assembly and said seat.

2. The rowing machine of claim 1, wherein:

said cable resists being pulled in a first direction;

said seat includes a rear facing edge facing in said first direction;

said seat includes a front facing edge facing in a second direction opposite said first direction;

said front facing edge of said seat is disposed between said rear facing edge of said seat and said first receiver; and said front facing edge of said seat is disposed between said rear facing edge of said seat and said second receiver.

3. The rowing machine of claim 1, further comprising a seat attachment configured to selectively engage said seat and facilitate the movement of said seat via said seat attachment.

4. The rowing machine of claim 3, wherein said seat attachment includes a foot platform having an angled surface configured to receive a force applied by a user, said force on said angled surface resulting in said movement of said seat.

5. The rowing machine of claim 4, said foot platform is selectively removable from said seat attachment.

6. The rowing machine of claim 3, wherein said seat attachment includes a handle configured to receive a force applied by a user, said force on said handle resulting in said movement of said seat.

7. The rowing machine of claim 6, wherein said handle is selectively removable from said seat attachment.

8. The rowing machine of claim 3, wherein said seat attachment includes a foot harness configured to selectively engage a user's foot and receive a force applied by said user, said force on said foot harness resulting in said movement of said seat.

9. The rowing machine of claim 8, wherein said foot harness is selectively removable from said seat attachment.

10. The rowing machine of claim 3, wherein:

said seat attachment includes a handle configured to receive a force applied by a user, said force on said handle resulting in said movement of said seat, said handle being selectively removable from said seat attachment and selectively attachable to said seat attachment; and said seat attachment includes a foot platform having an angled surface configured to receive a force applied by said user, said force on said angled surface resulting in said movement of said seat, said foot platform being selectively removable from said seat attachment and selectively attachable to said seat attachment.

11. The rowing machine of claim 3, wherein:

said seat attachment includes a handle configured to receive a force applied by a user, said force on said handle resulting in said movement of said seat, said handle being selectively removable from said seat attachment and selectively attachable to said seat attachment; and said seat attachment includes a foot harness configured to selectively engage a user's foot and receive a force applied by said user, said force on said foot harness resulting in said movement of said seat, said foot harness being selectively removable from said seat attachment and selectively attachable to said seat attachment.

12. The rowing machine of claim 3, wherein:

said seat attachment includes a foot platform having an angled surface configured to receive a force applied by said user, said force on said angled surface resulting in said movement of said seat, said foot platform being selectively removable from said seat attachment and selectively attachable to said seat attachment; and said seat attachment includes a foot harness configured to selectively engage a user's foot and receive a force applied by said user, said force on said foot harness resulting in said movement of said seat, said foot harness being selectively removable from said seat attachment and selectively attachable to said seat attachment.

13. The rowing machine of claim 3, wherein:

said seat attachment includes a foot platform having an angled surface configured to receive a force applied by said user, said force on said angled surface resulting in said movement of said seat, said foot platform being selectively removable from said seat attachment and selectively attachable to said seat attachment;

said seat attachment includes a foot harness configured to selectively engage a user's foot and receive a force applied by said user, said force on said foot harness resulting in said movement of said seat, said foot harness being selectively removable from said seat attachment and selectively attachable to said seat attachment; and said seat attachment includes a handle configured to receive a force applied by a user, said force on said handle resulting in said movement of said seat, said handle being selectively removable from said seat attachment and selectively attachable to said seat attachment.

14. The rowing machine of claim 1, further comprising a bench having a frame, said frame of said bench having an elongated channel disposed on a bottom side of said bench and being configured to selectively engage said frame of said rowing machine.

15. The rowing machine of claim 14, wherein said bench includes a seat portion and a backrest, said seat portion being coupled to said frame of said bench and said backrest being pivotally coupled to said seat.

16. The rowing machine of claim 1, wherein said first receiver, said second receiver, and said plate are integral parts of a single monolithic structure.

17. The rowing machine of claim 16, wherein said first receiver, said second receiver, and said plate are formed from a single piece of sheet metal.

18. The rowing machine of claim 16, wherein said first receiver, said second receiver, and said plate have a same thickness.

19. The rowing machine of claim 1, wherein:

said first receiver is fastened to said plate; and said second receiver is fastened to said plate.

* * * * *